US005839367A

United States Patent [19]

Hashimoto

[11] Patent Number: 5,839,367

[45] Date of Patent: Nov. 24, 1998

[54] STAMP PRESSING DEVICE METHOD FOR STAMPING AND DATA PROCESSING APPARATUS USING THE SAME

[75] Inventor: Masayoshi Hashimoto, Joyo, Japan

[73] Assignee: Sharp Kabushiki Kaisha, Osaka, Japan

[21] Appl. No.: 599,930

[22] Filed: Feb. 12, 1996

[30] Foreign Application Priority Data

Mar. 29, 1995 [JP] Japan ..... 7-071276

[51] Int. Cl.[6] ..... B41J 1/10

[52] U.S. Cl. ..... 101/316; 101/327

[58] Field of Search ..... 101/316, 128.21, 101/128.4, 327, 127.1

[56] References Cited

U.S. PATENT DOCUMENTS

| | | | |
|---|---|---|---|
| 4,574,694 | 3/1986 | Dubuit | 101/316 |
| 5,454,309 | 10/1995 | Fujikawa et al. | 101/128.21 |
| 5,493,283 | 2/1996 | Hopper et al. | 340/825.34 |

FOREIGN PATENT DOCUMENTS

| | | | |
|---|---|---|---|
| 0048183 | 3/1984 | Japan | 101/316 |
| 62-151374 | 7/1987 | Japan . | |
| 5-334516 | 12/1993 | Japan . | |
| 5-342452 | 12/1993 | Japan . | |
| 6-227095 | 8/1994 | Japan . | |

*Primary Examiner*—John S. Hilten
*Attorney, Agent, or Firm*—Nixon & Vanderhye PC

[57] ABSTRACT

A stamp pressing device includes: a housing for housing at least two stamps; a selection mechanism for selecting one of the at least two stamps accommodated in the housing; and a pressing mechanism for pressing the selected stamp on a sheet. The housing includes a stamping room disposed opposite to the sheet, a first room provided for a first stamp on one side of the stamping room, and a second room provided for a second stamp on the other. The selection mechanism includes a replace mechanism for replacing one stamp in the stamping room with the other by moving the first and second stamps along an elongate direction in which the stamping room and the first and second rooms are disposed. The pressing mechanism presses the stamp which is placed in the stamping room against the sheet.

10 Claims, 19 Drawing Sheets

200
46
ROM
40
CPU
2
Keyboard
47
RAM
Mode SW
41
Print mechanism
5
20
Stamp change driver
42
Stamp change solenoid
44
Buzzer
Stamp driver
43
Stamp solenoid
23
Drawer
45
Stamp sensor
22A,22B
Display
3

FIG. 16

A

Your receipt
Thank you

Sun. 3/7/94 12:04
123456#1357 SUZUKI 01

| | |
|---|---|
| Dept 04 | ¥1,550 |
| Dept 05 | ¥380 |
| Dept 01 | ¥1.280 |
| ** SUBTOTAL | ¥3,210 |
| TAX | ¥96 |
| ** TOTAL | ¥3,306 |
| CASH TEND | ¥4,000 |
| CHANGE | ¥694 |

STAMP PRESSING DEVICE METHOD FOR STAMPING AND DATA PROCESSING APPARATUS USING THE SAME

BACKGROUND OF THE INVENTION

1. Field of the Invention

The present invention relates to a stamp pressing device for stamping a sheet and data processing apparatus comprising the stamp pressing device.

2. Description of the Related Art

When money is paid by check in a store, the check is usually endorsed by a clerk to limit a person (or an organization) who can cash the check in a financial institution such as a bank so that an improper cashing is prevented. The check is endorsed by recording information on the back which restricts a payee.

In conventional data processing apparatus such as electronic cash registers, the endorsement is performed by printing. For example, in a conventional electronic cash register, a check is inserted into a printing system through a receipt outlet for outputting receipts on which calculation results such as a total are printed. An endorsement is printed on the check by using the same printing system which is used for printing the calculation results on receipts.

However, in such a conventional data processing apparatus, the printing system utilizes a complicated structure in order to print the endorsement, resulting in an increase of the cost of the apparatus. In order to simplify the structure of the printing system, another printer may be additionally provided for purpose of printing the endorsement. However, the additional printer also raises the cost of the apparatus.

Some conventional data processing apparatus such as electronic cash registers have a stamp device therein for stamping information such as a store name in an appropriate location on the receipt paper. The stamp device comprises a single stamp which is electrically controlled to stamp the receipt paper. Thus, such a stamp device is difficult to use also for printing an endorsement because the stamp has to be replaced with another one designed for endorsement prior to stamping. This is both bothersome for an operator and requires time for performing the replacement.

In addition, an endorsement operation should be supervised and restricted to qualified personnel. Conventional data processing apparatus cannot identify whether an operator is a person permitted to conduct an endorsement operation, so that the endorsing operation cannot be supervised or controlled.

SUMMARY OF THE INVENTION

The stamp pressing device of this invention comprises: a housing for housing at least two stamps; a selection mechanism for selecting one of the at least two stamps accommodated in the housing; and a pressing mechanism for pressing the selected stamp on a sheet.

In one embodiment of the invention, the housing includes a stamping room disposed opposite to the sheet, a first room provided for a first stamp on one side of the stamping room, and a second room provided for a second stamp on the other. The selection mechanism includes a replace mechanism for replacing one stamp in for indicating a setting error based on the detection of the sheet detecting mechanism.

In still another embodiment of the present invention, the stamp pressing device further comprises: an operator code memory for storing code numbers for operators who are permitted to perform a stamp transaction, a memory for storing an entered code number of a current operator, a judge mechanism for judging whether the entered code number matches one of the code numbers stored in the operator code memory, and a mechanism for prohibiting the stamp transaction when the entered code number does not match any of the code numbers stored in the operator code memory.

In still another embodiment of the present invention, the stamp pressing device further comprises: a PIN memory for storing a predetermined PIN for a stamp transaction, a memory for storing an entered PIN of a current operator, a judge mechanism for judging whether the entered PIN matches the predetermined PIN stored in the memory and a mechanism for prohibiting the stamp transaction when the entered PIN does not match the predetermined PIN stored in the PIN memory.

In still another embodiment of the present invention, the data processing apparatus comprises a stamp pressing device. The stamp pressing device comprises: a housing mechanism for housing at least two stamps; a selection mechanism for selecting one of the at least two stamps accommodated in the housing; and a pressing mechanism for pressing the selected stamp on a sheet. the stamping room with the other by moving the first and second stamps along an elongate direction in which the stamping room and the first and second rooms are disposed. The pressing mechanism presses the stamp which is placed in the stamping room against the sheet.

In another embodiment of the present invention, the housing includes a holder for holding the first and second stamps coupled in a series, and the replace mechanism includes a first member for forcing the coupled stamps towards one side of the housing along the elongate direction and a second member for moving the coupled stamps towards the other against the force of the first member, whereby one of the coupled stamps is placed in the stamping room.

In still another embodiment of the present invention, the stamp pressing device further comprises: an accommodation detecting mechanism for detecting whether the at least two stamps are accommodated correctly in the housing, and a warning mechanism for indicating an accommodation error based on the detection of the accommodation detecting mechanism.

In still another embodiment of the present invention, the warning mechanism makes a different kind of warning for each stamp.

In still another embodiment of the present invention, the stamp pressing device further comprises: a sheet detecting mechanism for detecting prior to a stamping operation whether the sheet is correctly set at a predetermined position, and another warning mechanism In still another embodiment of the present invention, the housing includes a stamping room disposed opposite to the sheet, a first room provided for a first stamp on one side of the stamping room, and a second room provided for a second stamp on the other. The selection mechanism includes a replacing mechanism for replacing one stamp in the stamping room with the other by moving the first and second stamps along a direction in which the stamping room and the first and second rooms are disposed. The pressing mechanism presses the stamp which is placed in the stamping room against the sheet.

In still another embodiment of the present invention, the first and second stamps are coupled in a series, and the replacing mechanism includes a first member for forcing the coupled stamps towards the first room side and a second member for moving the coupled stamps towards the second room side against the force of the first member, whereby one of the coupled stamps is placed in the stamping room.

In still another embodiment of the present invention, the data processing apparatus further comprises: an accommodation detecting device for detecting whether the stamps are accommodated correctly in the housing, and a warning mechanism for indicating an accommodation error based on the detection of the accommodation detecting device.

In still another embodiment of the present invention, the warning mechanism makes a different kind of warning for each stamp.

In still another embodiment of the present invention, the data processing apparatus further comprises: a sheet detecting mechanism for detecting prior to a stamping operation whether the sheet is correctly set at a predetermined position, and another warning mechanism for indicating a setting error based on the detection of the sheet detecting mechanism.

In still another embodiment of the present invention, the data processing apparatus further comprises: an operator code memory for storing code numbers for operators who are permitted to perform a stamp transaction, a memory for storing an entered code number of a current operator, a judge mechanism for judging whether the entered code number matches one of the code numbers stored in the operator code memory, and a mechanism for prohibiting the stamp transaction when the entered code number does not match any of the code numbers stored in the operator code memory.

In still another embodiment of the present invention, the data processing apparatus further comprises: a PIN memory for storing a predetermined PIN for a stamp transaction, a memory for storing an entered PIN of a current operator, a judge mechanism for judging whether the entered PIN matches the predetermined PIN stored in the memory, and a mechanism for prohibiting the stamp transaction when the entered PIN does not match the predetermined PIN stored in the PIN memory.

A method of this invention is a method for stamping using at least two stamps and a stamp pressing device comprising a housing for housing the at least two stamps. The housing has a stamping room, a first room for a first stamp on one side of the stamping room, and a second room for a second stamp on the other. The method includes the steps of: (a) selecting one of the at least two stamps accommodated in the housing; (b) placing the selected stamp in the stamping room; and (c) pressing the selected stamp against a sheet.

In one embodiment of the present invention, step (b) includes step (b1) of replacing one stamp in the stamping room with the other by moving the first and second stamps along a direction in which the stamping room and the first and second rooms are disposed.

In another embodiment of the present invention, the first and second stamps are coupled in a series, and step (b1) includes the steps of: (b2) forcing the coupled stamps towards the first room side; and (b3) moving the coupled stamps towards the second room side against the force applied in step (b2), whereby one of the coupled stamps is placed in the stamping room.

In still another embodiment of the present invention, the method of stamping further comprises the steps of: (d) detecting whether the stamps are accommodated correctly in the housing, and (e) indicating and warning an accommodation error based on a detection result of step (d).

In still another embodiment of the present invention, in step (e), a different kind of warning is made for each stamp.

In still another embodiment of the present invention, the method of stamping further comprises the steps of: (f) detecting prior to a stamping operation whether the sheet is correctly set at a predetermined position, and (g) indicating and warning a setting error based on a detection result of step (f).

In still another embodiment of the present invention, the method of stamping further comprises the step of: (h) storing code numbers in a memory prior to a stamping transaction for operators who are permitted to perform a stamp transaction; (i) storing an entered code number of a current operator; (j) judging whether the entered code number matches one of the code numbers stored in the memory; and (k) prohibiting the stamp transaction when the entered code number does not match any of the code numbers stored in the memory.

In still another embodiment of the present invention, the method of stamping further comprising the steps of: (1) storing a predetermined PIN for a stamp transaction in a memory; (m) storing an entered PIN of a current operator; (n) judging whether the entered PIN matches the predetermined PIN stored in the memory; and (o) prohibiting the stamp transaction when the entered PIN does not match the predetermined PIN stored in the memory.

A stamp pressing device of this invention comprises: a stamp housing for housing at least two stamps, including a frame box having an elongate box shape, including a stamping room, a first room disposed on one side of the stamping room along the elongate direction, and a second room disposed on the other, and a holder box slidably provided in the frame box along the elongate direction, for holding the at least two stamps arranged in a row along the elongate direction; a selection mechanism including an elastic member provided between the frame box and the holder box so as to bias the holder box towards the second room side to a first position in the frame box, a first stamp being placed in the stamping room at the fist position, and a first moving member coupled to the holder box and for sliding the holder box towards the first room side against the elastic force of the elastic member to a second position in the frame box, a second stamp being placed in the stamping room at the second position; and a pressing mechanism provided so as to face the stamping room and including a second moving member for moving in a direction perpendicular to the elongate direction of the frame box and for pressing a stamp placed in the stamping room against a sheet.

In one embodiment of the present invention, the frame box has a guide slot for guiding the holder box to slide along the elongate direction in the frame box.

In another embodiment of the present invention, the frame box has a second guide slot for guiding the stamp in the stamping room to slide towards the sheet and to return to a previous position in the stamping room.

In still another embodiment of the present invention, the frame box has a lock mechanism for holding the holder box at the second position against the elastic force of the elastic member.

In still another embodiment of the present invention, the frame box has a release mechanism for releasing the lock mechanism when the stamp returns to the stamping room after stamping on the sheet, whereby the holder box is moved from the second position to the first position by the elastic force of the elastic member.

Thus, the invention described herein makes possible the advantages of (1) providing a stamp pressing device in which a stamp operation such as the recording of an endorsement can be performed using a relatively simple structure without an increase in cost, (2) providing a stamp pressing device in which a stamp operation is well supervised, and (3) providing a data processing apparatus comprising the stamp pressing device.

These and other advantages of the present invention will become apparent to those skilled in the art upon reading and understanding the following detailed description with reference to the accompanying figures.

BRIEF DESCRIPTION OF THE DRAWINGS

FIG. 16 is a diagram showing an example of a normal stamp on a receipt.

DESCRIPTION OF THE PREFERRED EMBODIMENT

Hereinafter, the present invention will be described by way of an illustrative example with reference to the accompanying drawings.

Figure 1:
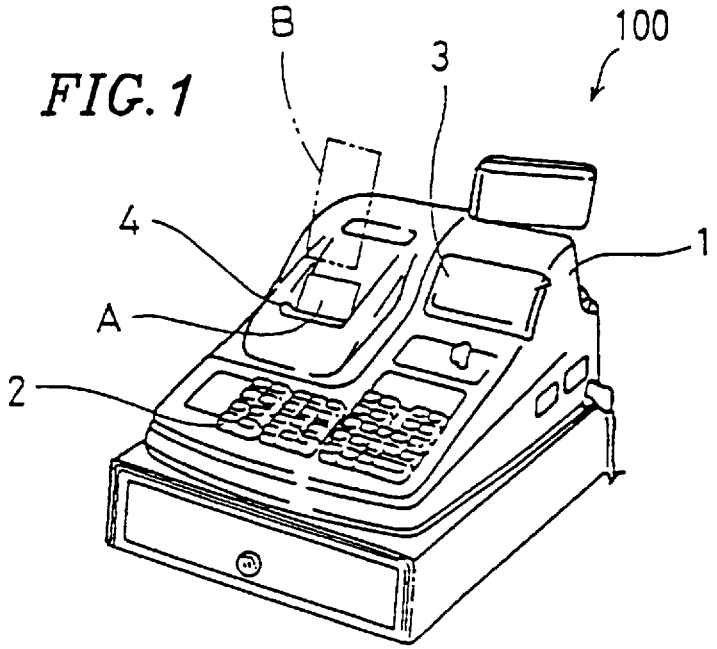
FIG. 1 is a perspective view of an electronic cash register according to one embodiment of the present invention.

FIG. 1 is a perspective view of an electronic cash register 100 according to one embodiment of the present invention. As shown in FIG. 1, the electronic cash register 100 comprises a body case 1, a keyboard 2 for inputting data, a display 3 for displaying calculations, resultant totals and the like, and a receipt outlet 4 for outputting a receipt A on which a calculation result is printed and for inserting a check B into the body case 1 to be endorsed.

Figure 2:
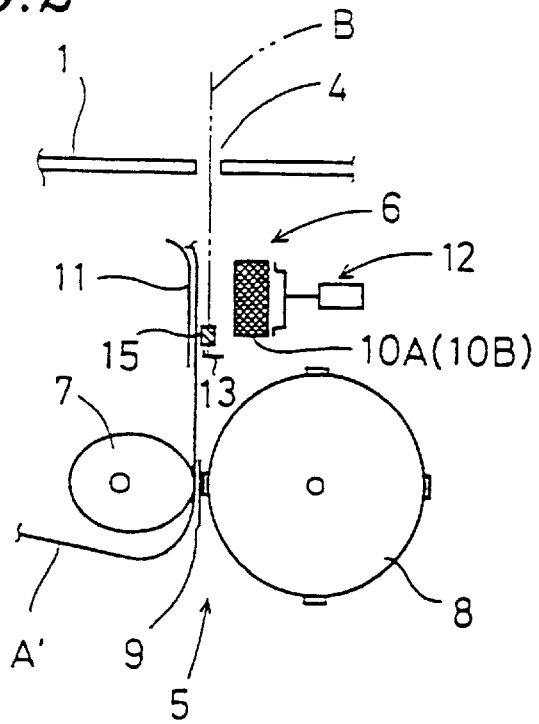
FIG. 2 is a schematic view of the print and stamp mechanism of the electronic cash register according to one embodiment of-the present invention.

As shown in FIG. 2, the electronic cash register 100 comprises a print mechanism 5 and a stamp mechanism 6 inside the body case 1. The print mechanism 5 is provided in a traveling path of receipt paper A', and includes a print roller 7 and a print wheel 8. Ink of an ink ribbon 9 is transferred to the receipt paper A' by the print roller 7 and the print wheel 8. The stamp mechanism 6 is provided above the print mechanism 5, and includes a normal stamp 10A, an endorsement stamp 10B, a stamp stand 11, and a presser 12. The stamp 10A (or 10B) faces the stamp stand 11. A top end of receipt paper A' which travels from the print mechanism 5 or a bottom end of a check B which is inserted via the receipt outlet 4 is sandwiched between the stamp 10A (or 10B) and the stamp stand 11. The presser 12 presses the stamp 10A (or 10B) toward the stamp stand 11 whereby the stamp 10A (or 10B) is stamped on the receipt paper A' (or check B).

Figure 3:
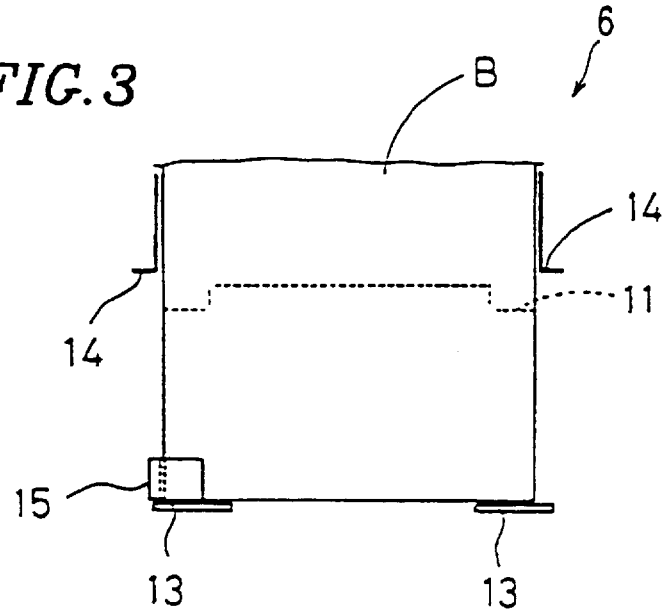
FIG. 3 is a side plan view of the stamp mechanism of the electronic cash register according to one embodiment of the present invention.

As shown in FIG. 3, a stopper 13, a check guide 14, and a check sensor 15 are provided close to the stamp stand 11 in the stamp mechanism 6. The stopper 13 receives a leading edge of the check B which is inserted via the receipt outlet 4. The check guide 14 guides both sides of the check B, and the check sensor 15 optically detects the inserted check B.

Figure 4:
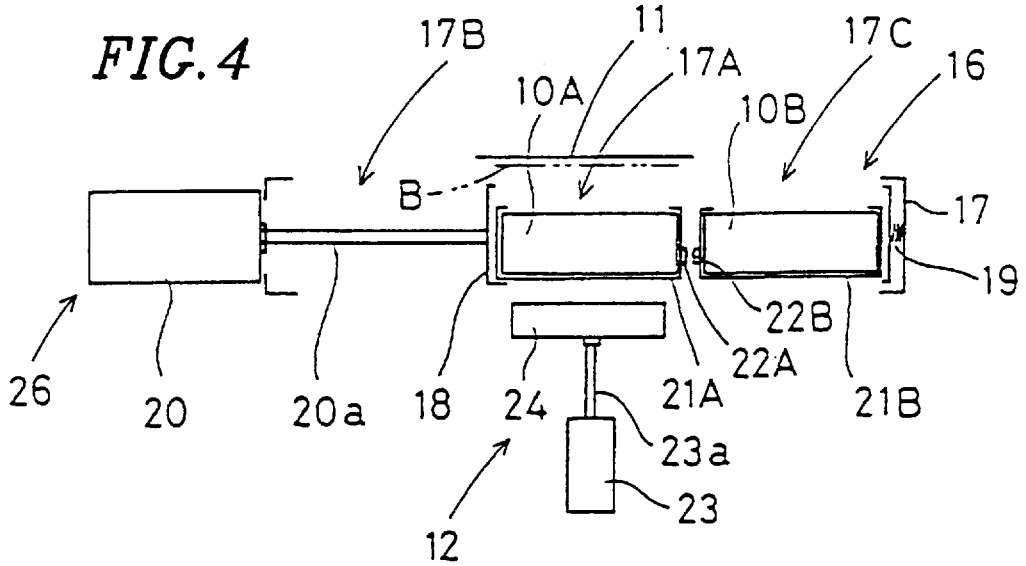
FIG. 4 is a top plan view of the stamp mechanism of the electronic cash register according to one embodiment of the present invention.
Figure 5:
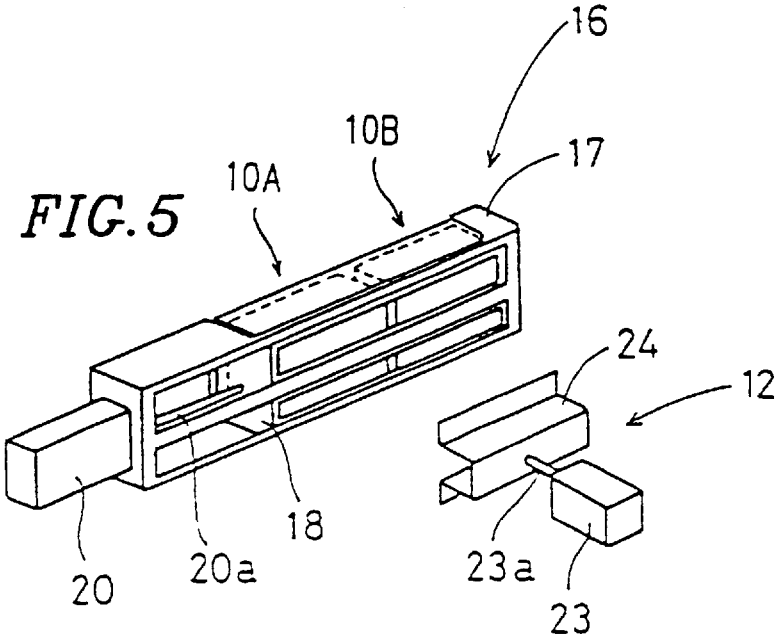
FIG. 5 is a perspective view of the holder and presser of the stamp mechanism.

The normal stamp 10A is used for usual stamping of a store name, a "Thank You" message, and/or the like on the receipt paper A'. The endorsement stamp 10B is used for stamping an endorsement on the check B. As shown in FIGS. 4 and 5, the stamps 10A and 10B are accommodated in a housing 16.

Figure 7A:
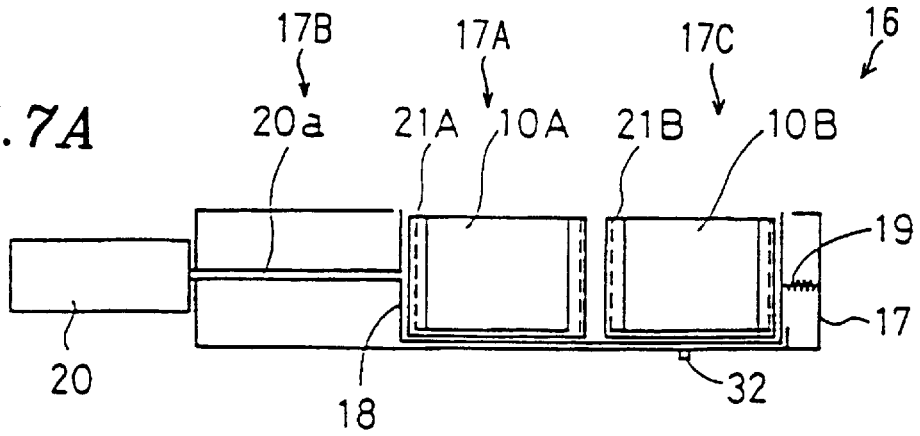
FIGS. 7A and 7B are schematic views of a housing viewed from a presser side in the stamp mechanism.

As shown in FIGS. 4 and 5, the housing 16 comprises a stamp box 17 having an elongate box shape. The stamp box 17 includes a middle stamping room 17A, a normal stamp room 17B on one side of the middle stamping room 17A, and an endorsement stamp room 17C on the other. These rooms are arranged in a row along the elongate direction of the stamp box 17. A holder box 18 is slidably provided in the stamp box 17 along the elongate direction of the stamp box 17. The holder box 18 has an elongate width capable of placing the stamps 10A and 10B in a row. A compression spring 19 is disposed between an outside wall of the holder box 18 and an inside wall of the endorsement stamp room 17C. The holder box 18 is forced toward the endorsement stamp room 17C side by elastic force of the compression spring 19. Thus, the holder box 18 is ordinarily laid across the stamping room 17A and the endorsement stamp room 17C at a standard position, as shown in FIG. 7A.

Figure 7B:
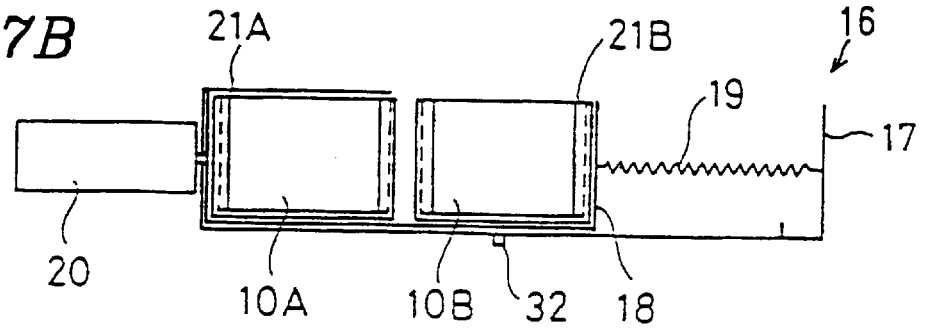

A stamp change solenoid 20 is provided on an outer end on the normal stamp room 17B side of the stamp box 17. The stamp change solenoid 20 has an extension/retraction rod 20*a* which is coupled to the holder box 18. The stamp change solenoid 20 moves the holder box 18 by using the extension/retraction rod 20*a* so that the holder box 18 slides toward the normal stamp room 17B against the elastic force of the compression spring 19. When the holder box 18 is fully pulled by the stamp change solenoid 20, the holder box 18 is laid across the normal stamp room 17B and the stamping room 17A at a pulled-end position, as shown in FIG. 7B. When the pulling operation of the stamp change solenoid 20 is stopped, the holder box 18 is pulled back to the standard position by the elastic force of the compression spring 19. In this example, the stamp change solenoid 20 and the compression spring 19 form a stamp selection section 26.

As shown in FIG. 4, the holder box 18 comprises a pair of holder angles 21A and 21B. The holder angle 21A holds the normal stamp 10A, and the holder angle 21B holds the endorsement stamp 10B. The holder angles 21A and 21B include stamp sensors 22A and 22B on adjacent side faces thereof, respectively.

Figure 6:
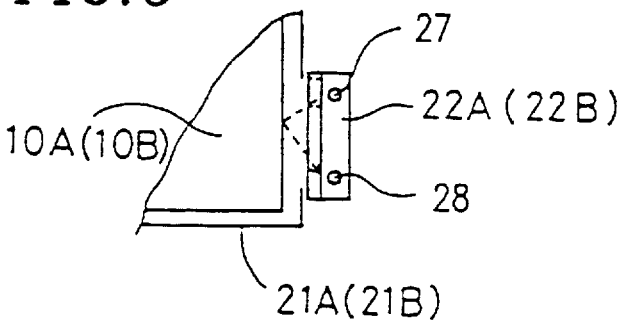
FIG. 6 is an enlarged view of the stamp sensor provided on the holder angle.

As shown in FIG. 6, the stamp sensor 22A is provided on the side portion of the holder angle 21A so as to face a side face of the normal stamp 10A accommodated in the holder angle 21A. Similarly, the stamp sensor 22B is provided on a side portion of the holder angle 21B so as to face a side face of the endorsement stamp 10B accommodated in the holder angle 21B. Each of the stamp sensors 22A and 22B includes a light-emitter 27 and a light-detector 28. The light-emitter 27 emits a sensor beam to the side face of the stamp 10A (10B) and the light-detector 28 receives the sensor beam reflected by the side face, whereby the presence of stamp 10A (10B) is detected.

Crossing (improper accommodation) of the stamps 10A and 10B can be detected by using the stamp sensors 22A and 22B as follows. The side faces of the stamps 10A and 10B which face the stamp sensors 22A and 22B, respectively, are painted with a high-reflective color such as white, while the other side faces of the stamps 10A and 10B which do not face the respective stamp sensors 22A and 22B are painted with a low-reflective color such as black.

When the stamps 10A and 10B are accommodated correctly in the holder angles 21A and 21B, the high-reflective side faces of the stamps 10A and 10B are opposed to the stamp sensors 22A and 22B. As a result, light emitted by the light-emitter 27 is reflected from the side faces of the stamps 10A and 10B and detected by the light-detector 28 of the stamp sensors 22A and 22B, respectively, to indicate the correct accommodation. If the stamps 10A and 10B are crossed and accommodated in wrong holder angles 21B and 21A, the low-reflective side faces of the stamps 10A and 10B are opposed to the stamp sensors 22A and 22B, resulting in little or no light being reflected from the stamps 10A and 10B. Consequently, the light-detector 28 does not detect any reflected light from the stamps 10A and 10B, indicating the improper accommodation of the stamps 10A and 10B. When the holder angles 21A and 21B do not accommodate either of the respective stamps 10A and 10B, the stamp sensor 22A or 22B does not receive reflected light and an improper accommodation is indicated.

The presser 12 is provided opposite the stamping room 17A, as shown in FIGS. 4 and 5. The presser 12 includes a stamp solenoid 23 having an extension/retraction rod 23*a*, and a presser angle 24 which is attached to one end of the extension/retraction rod 23*a*. The presser angle 24 faces the stamping room 17A through openings of the stamp box 17 and the holder box 18, as shown in FIG. 5.

Figure 8A:
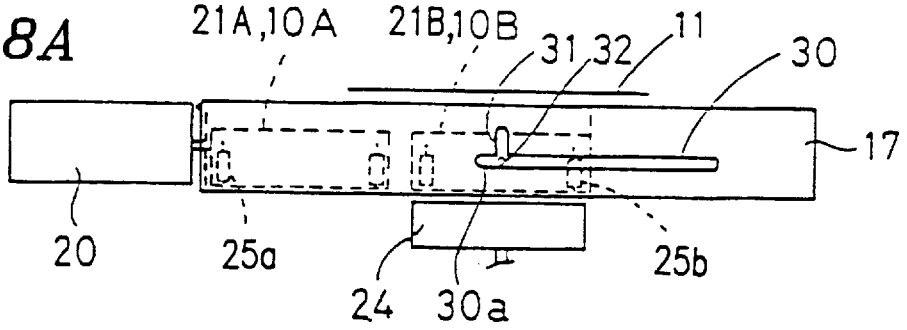
FIGS. 8A and 8B are schematic views of the stamp mechanism viewed from the top.
Figure 8B:
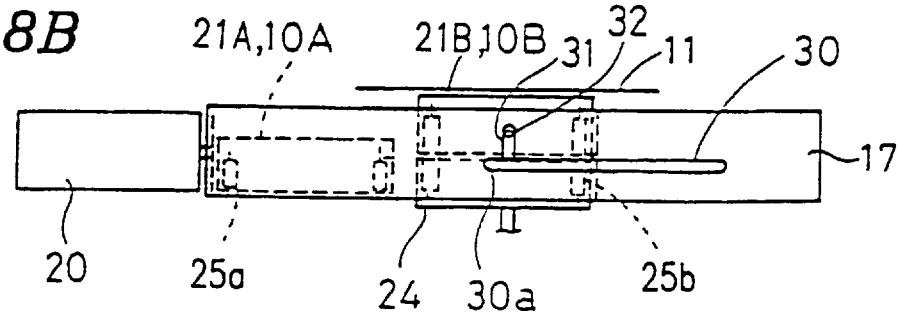

As shown in FIGS. 8A and 8B, compression springs 25*a* are provided between an inner wall on the stamp solenoid 23 side of the holder box 18 and the holder angle 21A. Similarly, compression springs 25*b* are provided between the inner wall of the holder box 18 and the holder angle 21B. When activated, the extension/retraction rod 23*a* of the stamp solenoid 23 is extended. The presser angle 24 presses the holder angle 21B and the endorsement stamp 10B held therein against the stamp holder 11, when the holder box 18 is at the pulled-end position and the endorsement stamp 10B and the holder angle 21B are in the stamping room 17A, as shown in FIGS. 7A, 8A, and 8B. Similarly, when the holder box 18 is at the standard position, the presser slide guiding slot 30 when the endorsement stamp 10B is accommodated in the holder angle 21B. Accordingly, the endorsement stamp 10B held in the holder angle 21B slides between the endorsement stamp room 17C and the stamping room 17A guided by the slide guiding slot 30, during the stamp change operation by the stamp change solenoid 20. The endorsement stamp 10B is also guided by the press guiding slot 31 in the stamp room 17A, during the stamp operation by the stamp solenoid 23.

Next, the structure of a lock mechanism which is provided on the bottom face of the stamp box 17 will be described.

As shown in FIGS. 9A to 9F, a lock lever 33 having a right triangle shape is provided in a place where the press guiding slot 31 branches from the slide guiding slot 30. The lock lever 33 is disposed so that the right angle 33*a* is placed close to the root of the press guiding slot 31, a shorter leg and a longer leg are placed along the press guiding slot 31 and the slide guiding slot 30, respectively, with the hypotenuse 33*b* crossing the slide guiding slot 30. The lock lever 33 is pivotable around a pivot of one angle 33*c* which is positioned on the slide guiding slot 30 side.

A compression spring 34 is provided between the lock lever 33 and the stamp box 17, which forces the lock lever 33 in a clockwise direction as viewed in the figures. A stopper 38 is provided at an upper (i.e., the stamp stand 11 side) edge of the slide guiding slot 30 so as to face the hypotenuse 33*b* of the lock lever 33. The clockwise movement of the lock lever 33 is regulated by angle 24 presses the holder angle 21A and the normal stamp 10A held therein against the stamp holder 11 (not shown).

When the pressing operation by the presser 12 is finished and the stamp solenoid 23 stops extending the extension/retraction rod 23*a*, the holder angle 21A (21B) and the stamp 10A (10B) held therein are pulled back toward the inner wall of the holder box 18 into the stamp box 17 by the elastic force of the compression springs 25*a* (25*b*). Thus, the stamp operation by the stamp mechanism 6 is completed.

Next, a guiding system of the stamp mechanism 6 will be described below.

As shown in FIGS. 8A and 8B, the stamp box 17 has a slide guiding slot 30 which is formed on a bottom face thereof. The slide guiding slot 30 extends from a center portion of the stamp box 17 (beneath the stamping room 17A) towards the endorsement stamp room 17C along the elongate direction of the stamp box 17. A press guiding slot 31 is formed at an end of the slide guiding slot 30 beneath the stamping room 17A. The press guiding slot 31 branches from the slide guiding slot 30 towards the stamp stand 11 and is perpendicular to the slide guiding slot 30. The slide guiding slot 30 includes an extending portion 30*a* which extends from a root of the press guiding slot 31 towards the normal stamp room 17B.

The endorsement stamp 10B comprises a guiding projection 32 on a bottom face thereof, as shown in FIGS. 7A to 8B. The guiding projection is inserted in the the stopper 38.

A release lever 35 is provided on a face of the lock lever 33 along the other angle 33*d* thereof which is positioned on the press guiding slot 31 side. The release lever 35 has a triangle shape according to a shape of the other angle 33*d* of the lock lever 33. The release lever 35 is pivotable around a pivot of an angle 35*a* thereof which is positioned at the middle of the hypotenuse 33*b* of the lock lever 33. The release lever 35 includes a projection 35*b* which partially covers the press guiding slot 31. A compression spring 37 is provided between the lock lever 33 and the release lever 35 so as to force the release lever 35 in a counterclockwise direction as viewed in the figures. The lock lever 33 has a projection 36 for receiving the release lever 35. The counterclockwise movement of the release lever 35 is regulated by the projection 36, and the release lever 35 comes into contact with the projection 36 in an ordinary state.

Figure 10:
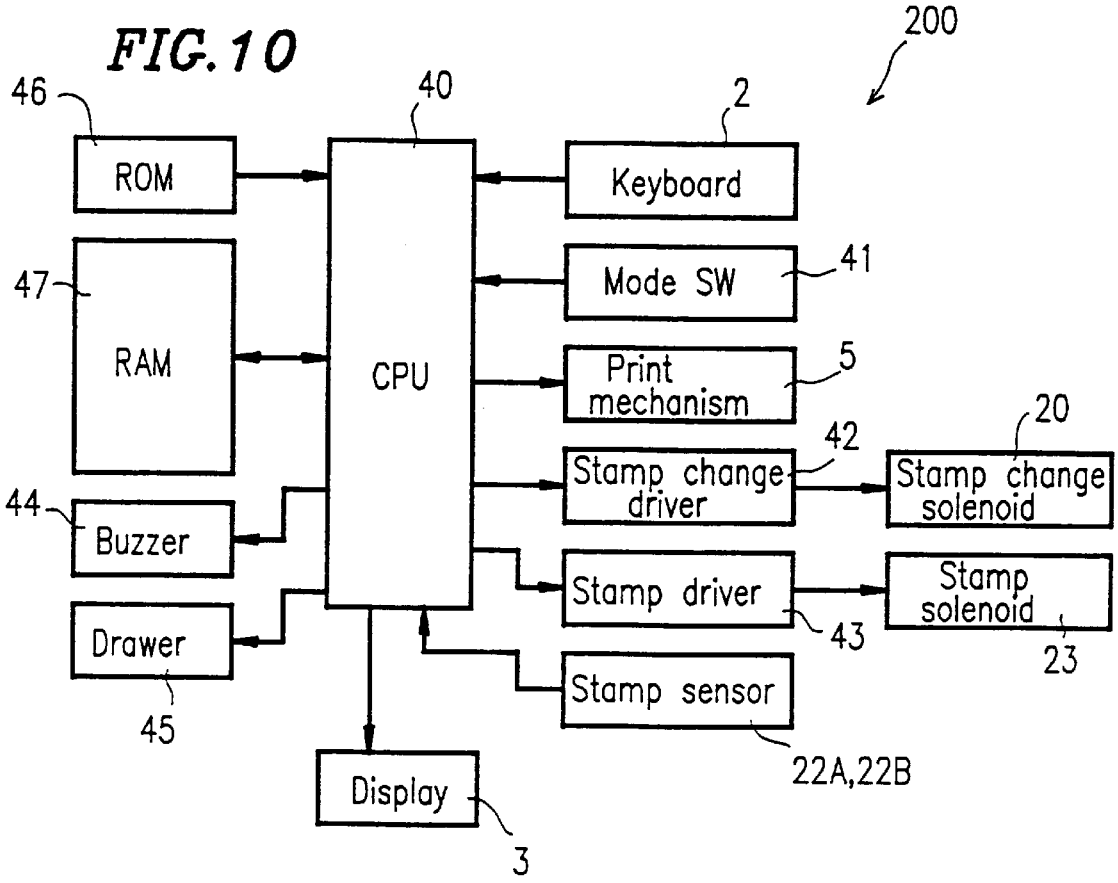
FIG. 10 is a block diagram illustrating a control system of the electronic cash register according to one embodiment of the present invention.

Next, the structure of a control circuit 200 of the electronic cash register 100 will be described. As shown in FIG. 10, the electronic cash register 100 includes a CPU 40 for controlling overall operation of the system. The CPU 40 is programmed using conventional techniques such that the system functions in accordance with the various transaction steps described herein.

The CPU 40 is coupled to the keyboard 2 which is used for inputting data for calculation, registration, and setting; a mode switch 41 for selecting one of the operation modes of registration, set-up, inspection, account, and the like; a print mechanism 5; a stamp change driver 42 for driving the stamp change solenoid 20; a stamp driver 43 for driving the stamp solenoid 23; the stamp sensors 22A and 22B; a buzzer 44 for beeping and warning of errors; the display 3 for displaying input data, errors, operation guides for new operators, and the like; and a drawer 45 for containing bills, coins, checks, and the like. The CPU 40 also includes a ROM 46 and a RAM 47. The ROM 46 stores commands to control each mechanism, regular displays, printing messages, and the like. The RAM 47 stores display buffer data, current operator data, endorsement information, flags which are used to control each mechanism, counter data, buffer data, and the like.

Figure 11:
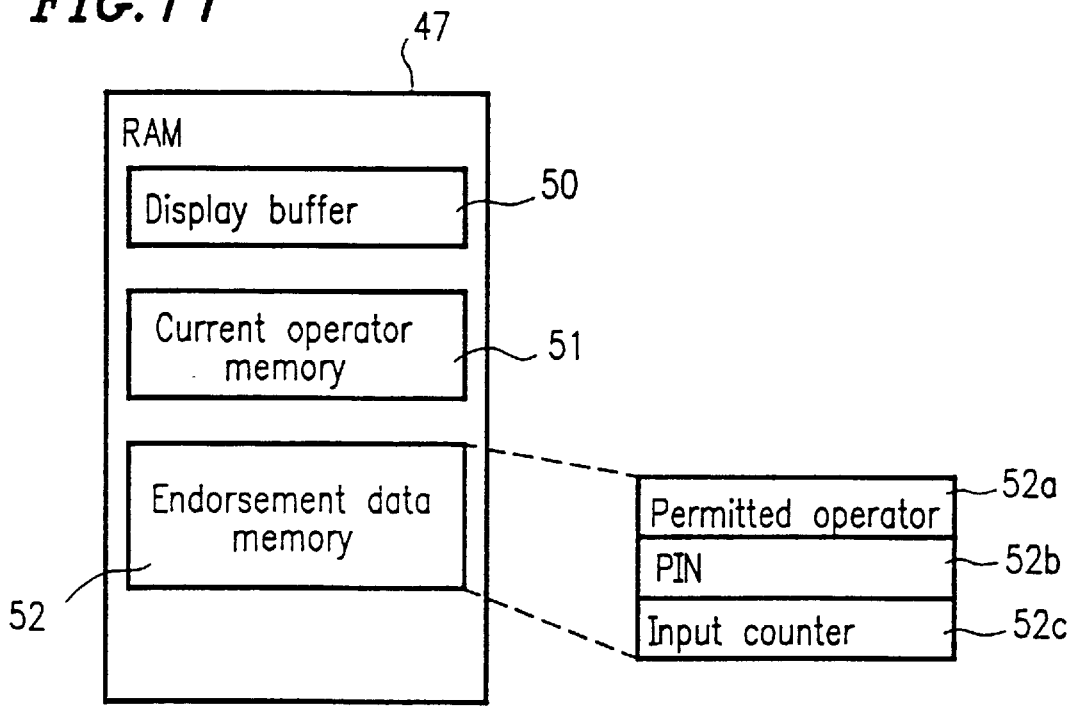
FIG. 11 is a block diagram illustrating the configuration of the RAM shown in FIG. 10.

As shown in FIG. 11, the RAM 47 includes a display buffer 50 for the display 3, a current operator memory 51 for storing an operator code of an operator who is operating the electric cash register 100, and an endorsement data memory 52 for storing endorsement transaction data. An operator code which is expressed, for example, by a 3-digit number is input via the keyboard 2 to the current operator memory 51 by the operator. The endorsement data memory 52 includes a permitted-operator memory 52*a*, a PIN (personal identification number) memory 52*b*, and an input counter 52*c*. Operator codes of operators who are qualified, i.e., permitted, to transact an endorsement are input to the permitted-operator memory 52*a* prior to the operation. The operator codes of the permitted operators are expressed, for example, by 3-digit numbers as same as an operator code of the current operator. A personal identification number (PIN) which is expressed, for example, by 4-digit number is input to the PIN memory 52*b* prior to the operation. A plurality of PINs may be stored in the PIN memory 52*b*.

Figure 12:
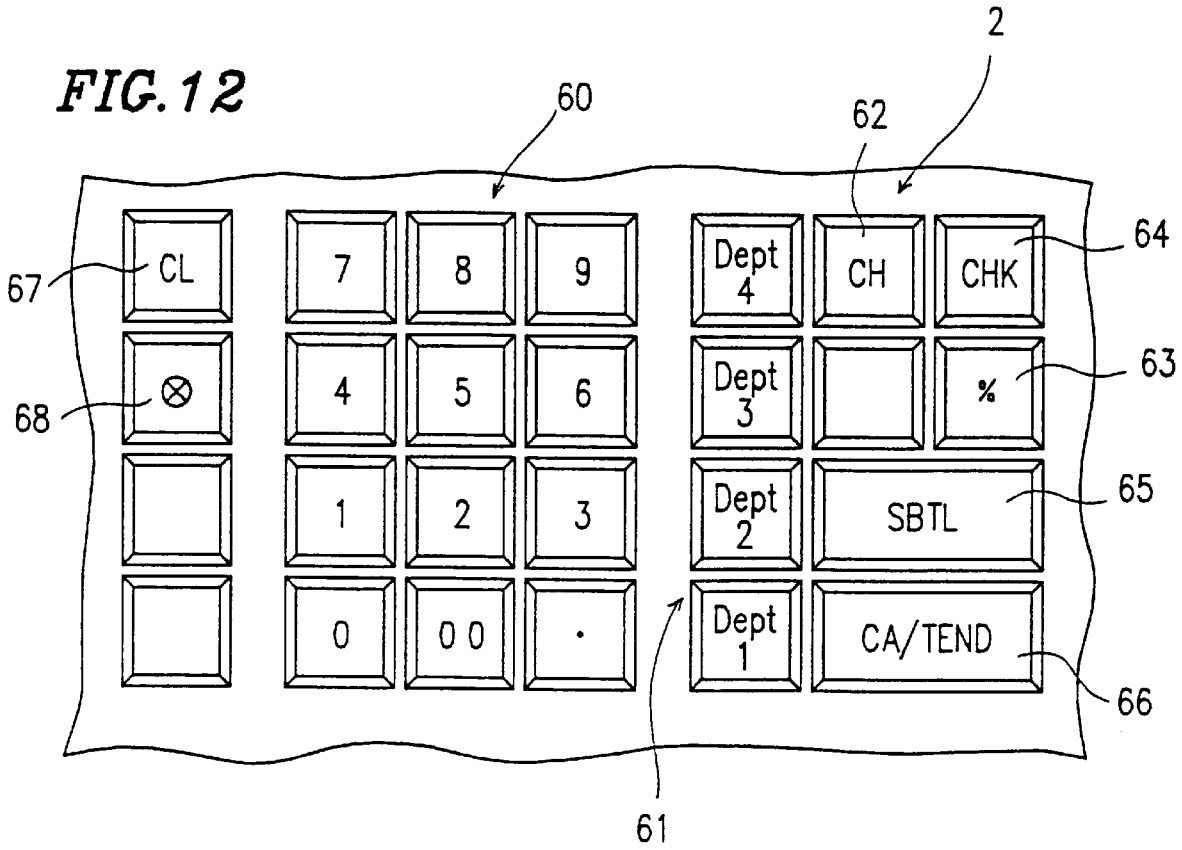
FIG. 12 is a diagram illustrating the keyboard of the electronic cash register according to one embodiment of the present invention.

As shown in FIG. 12, the keyboard 2 includes a numeric key pad 60 for inputting numeric data such as unit prices, amounts, quantity, operator codes of operators, and the like, a department key pad 61 used for registering the category of merchandise of each item to allow for sales analysis, a CH key 62 for registering credit or charge sales, a percentage (%) key 63 used for inputting discount or add-on price, a CHK key 64 used for registering payments by check or gift certificate, and for indicating an endorsement transaction, a SBTL key 65 for calculating and displaying subtotals, a CA/TEND key 66 used for cash sales, cash tender, and change, a CL key 67 for clearing and correcting input errors and for stopping a long warning beep, and a multiplication key 68 used for registering a multiplication (i.e., quantity).

Next, stamp operations of the normal stamp 10A and the endorsement stamp 10B in the stamp mechanism 6 will be described.

Figure 13:
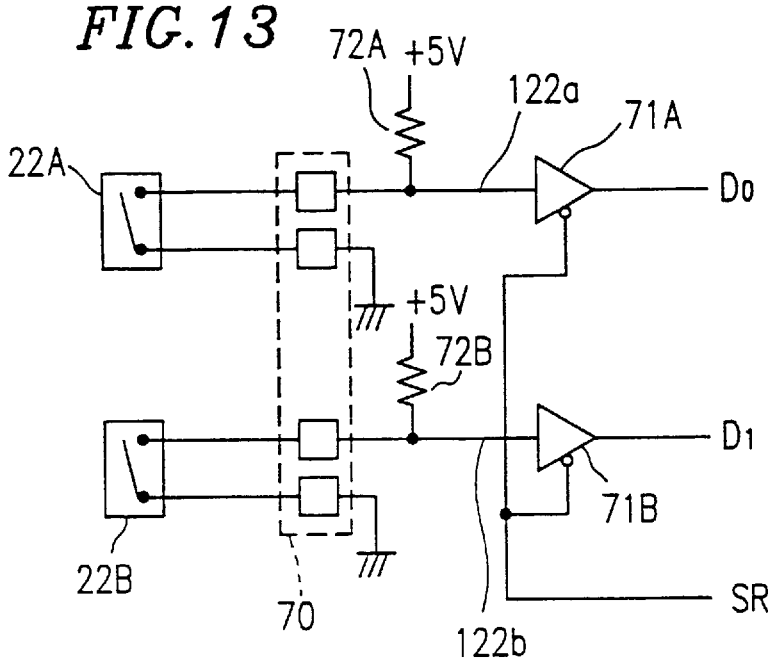
FIG. 13 is a diagram illustrating the structure of the stamp sensors.

First, operations for detecting accommodation of the normal stamp 10A and the endorsement stamp 10B will be explained. As shown in FIG. 13, the stamp sensors 22A and 22B are coupled to respective inputs of buffers 71A and 71B via a connector 70. Pull-up resistors 72A and 72B are also coupled to the inputs of buffers 71A and 71B, respectively. The outputs of buffers 71A and 71B are connected to the CPU 40 (not shown in FIG. 13). Control terminals of the buffer 71A and 71B are also connected to the CPU 40, so that a stamp read signal SR is input to the control terminals from the CPU 40. The stamp read signal SR directs a detect operation of the accommodation of the normal stamp 10A and the endorsement stamp 10B.

Figure 14:
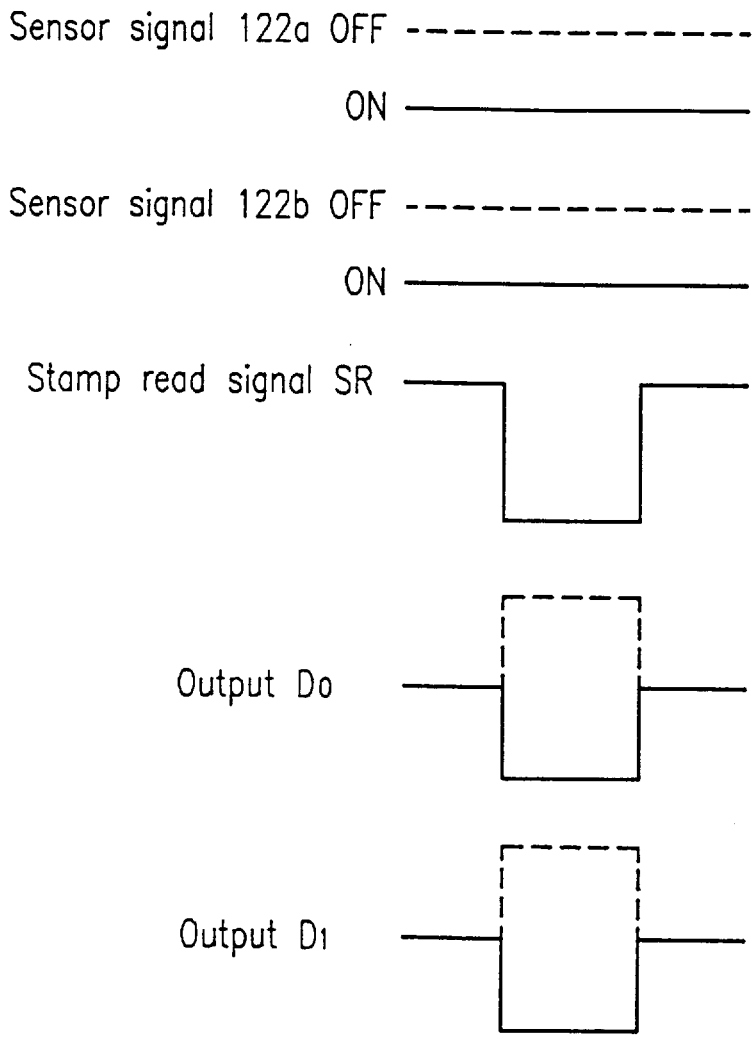
FIG. 14 is a diagram illustrating the signals used for detecting the accommodation of the stamps.

When a normal transaction is performed, the CPU 40 executes a stamp read command so as to output the stamp read signal SR to the buffer 71A. As shown in FIG. 14, the stamp read signal SR is a low pulse signal. When the stamp read signal SR is input, the buffer 71A is enabled and a stamp sensor signal 122*a* from the stamp sensor 22A is output from the buffer 71A as an output signal $D_0$ as shown in FIGS. 13 and 14.

In the case where the normal stamp 10A is accommodated correctly in the holder angle 21A of the housing 16 (see FIG. 4), the stamp sensor 22A is turned on so that the sensor signal 122*a* having a low level is input to the buffer 71A. Thus, the output signal $D_0$ has a low level, as indicated by solid line in FIG. 14. In the case where the normal stamp 10A is wrongly accommodated or not accommodated in the housing 16, the stamp sensor 22A is turned off. Since the input terminal of the buffer 71A is connected to a voltage of 5V via the pull-up resistor 72A, the sensor signal 122*a* having a high level is input to the buffer 71A. Thus, the output signal $D_0$ goes high, as indicated by broken line in FIG. 14. The CPU 40 detects the accommodation of the normal stamp 10A by judging a level of the output signal-$D_0$ of the buffer 71A.

When an endorsement transaction is performed, the CPU 40 executes the stamp read command so as to output the stamp read signal SR to the buffer 71B. When the stamp read signal SR is input, the buffer 71B opens, so that a stamp sensor signal 122*b* from the stamp sensor 22B is output from the buffer 71B as an output signal $D_1$ as shown in FIGS. 13 and 14.

In the case where the endorsement stamp 10B is accommodated correctly in the holder angle 21B of the housing 16 (see FIG. 4), the stamp sensor 22B is turned on so that the sensor signal 122*b* having a low level is input to the buffer 71B. Thus, the output signal $D_1$ has a low level, as indicated by solid line in FIG. 14. In the case where the endorsement stamp 10B is wrongly accommodated or not accommodated in the housing 16, the stamp sensor 22B is turned off. Since the input terminal of the buffer 71B is connected to a voltage of 5V via the pull-up resistor 72B, the sensor signal 122*b* having a high level is input to the buffer 71B. Thus, the output signal $D_1$ goes high, as indicated by broken line in FIG. 14. The CPU 40 detects the accommodation of the endorsement stamp 10B by judging a level of the output signal $D_1$ of the buffer 71B.

Figure 15A:
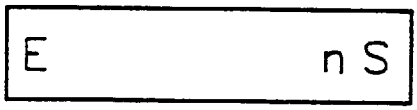
FIGS. 15A, 15B, 15C and 15D are diagrams showing error messages displayed on the display.
Figure 15C:
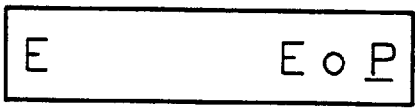
Figure 15B:
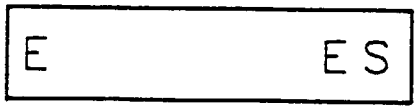

As a result of the judgement, when it is detected that the normal stamp 10A or the endorsement stamp 10B is absent from or wrongly accommodated in the corresponding holder angle, an error message is displayed in the display 3 as shown in FIGS. 15A or 15B. FIG. 15A shows an accommodation error of the normal stamp 10A, and FIG. 15B shows an accommodation error of the endorsement stamp 10B. At the same time, the buzzer 44 beeps as a warning of the error. The accommodation error of each stamp is distinguished, for example, by setting a warning sound for the normal stamp 10A as a low intermittent beeping and that for the endorsement stamp 10B as a high intermittent beeping.

Next, stamp operation and stamp change operation will be described.

At the standard position of the holder box 18, as shown in FIGS. 4 and 7A, the stamp change solenoid 20 is not driven and the holder box 18 is pulled back towards the endorsement stamp room 17C side by the compression spring 19. Thus, the normal stamp 10A which is held in the holder angle 21A is placed in the stamping room 17A at the standard position. The presser angle 24 which is driven by an extending operation of the stamp solenoid 23 presses the holder angle 21A and the normal stamp 10A held therein against the stamp stand 11. In this time, receipt paper A' is disposed between the stamp stand 11 and the holder 16, as shown in FIG. 2, after being subject to a print operation by the print mechanism 5. The receipt paper A' is stamped by the ordinary stamp 10A and output as a stamped receipt A, for example, with "Your Receipt, Thank You" as shown in FIG. 16.

When the stamp operation of the normal stamp 10A is finished, the stamp solenoid 23 stops extending so that the holder angle 21A holding the normal stamp 10 is pulled back into the holder box 18 by the compression spring 25.

Figure 9A:
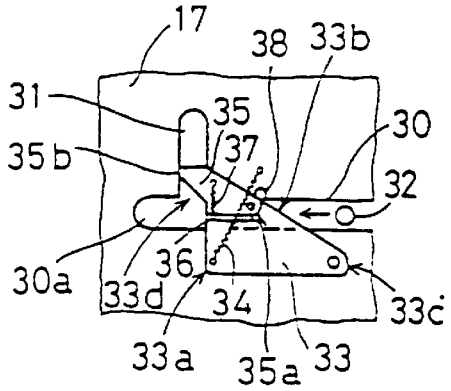
FIGS. 9A, 9B, 9C, 9D, 9E and 9F are bottom views of the stamp box for illustrating a sliding mechanism.
Figure 9B:
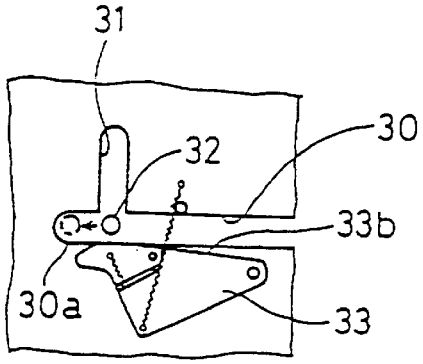

In an endorsement operation, as shown in FIGS. 7B and 8A, the stamp change solenoid 20 is driven so that the holder box 18 is pulled towards the normal stamp room 17B side against the elastic force of the compression spring 19. As a result, the endorsement stamp 10B is moved from the endorsement stamp room 17C to the stamping room 17A. When the endorsement stamp 10B is moving, as shown in FIGS. 9A and 9B, the guiding projection 32 which is provided on the bottom face of the endorsement stamp 10B moves along the slide guiding slot 30 so as to push the hypotenuse 33*b* of the lock lever 33 in the counterclockwise direction. Then, the guiding projection reaches the end of the extending portion 30*a* of the slide guiding slot 30 and the pulling operation of the stamp change solenoid 20 is completed.

When the guiding projection 32 reaches the root of the press guiding slot 31 (i.e., the beginning of the extending portion 30*a*), the guiding projection 32 engages with the projection 35*b* so as to further push the release lever 35 and the lock lever 33 in the counterclockwise direction, as shown in FIG. 9B. Then, when the guiding projection 32 moves further towards the end of the projection portion 33*a*, the guiding projection 32 leaves the projection 35*b*, so that the lock lever 33 is forced to rotate in the clockwise direction by the compression spring 34 and is stopped by the stopper 38, as shown in FIG. 9C.

At this time, the stamp change solenoid 20 stops pulling the holder box 18, so that the holder box 18 is pulled back towards the endorsement stamp box 17C side by the compression spring 19. As a result, the guiding projection 32 bumps against the shorter leg of the lock lever 33 at the foot of the projection 35*b*. Accordingly, against the elastic force of the compression spring 19, the holder box 18 stops moving so that the endorsement stamp 10B remains in the stamping room 17A. As described above, the lock lever 33 is provided in order to fix the endorsement stamp 10B in the stamping room 17A against the compression spring 19.

Figure 17:
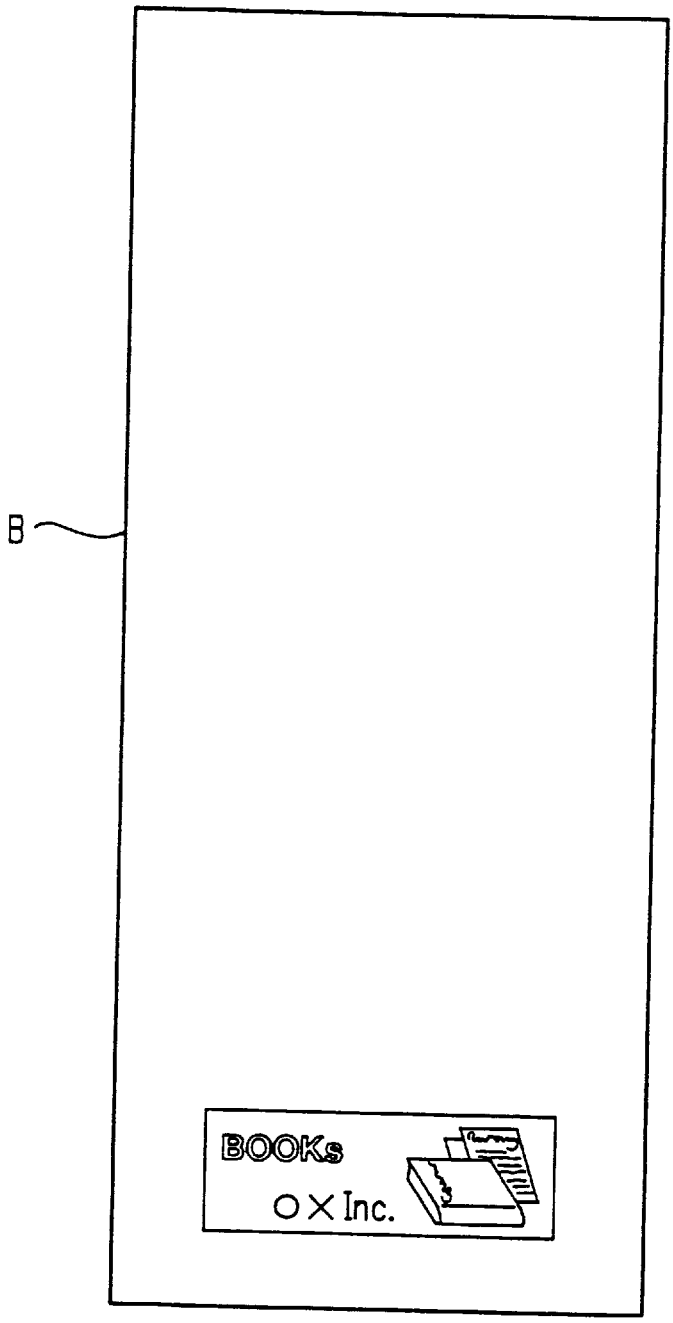
FIG. 17 is a diagram showing an example of an endorsement stamp on a check.

When the pulling operation by the stamp change solenoid 20 stops, then the stamp solenoid 23 extends towards the stamp stand 11 as shown in FIG. 8B. The presser angle 24 presses the endorsement stamp 10B against the stamp stand 11. At this time, a check B or the like is disposed between the stamp stand 11 and the housing 16, so that the check B or the like is stamped by the endorsement stamp 10B. FIG. 17 shows an example of a back of the check B stamped by the endorsement stamp 10B.

Figure 9C:
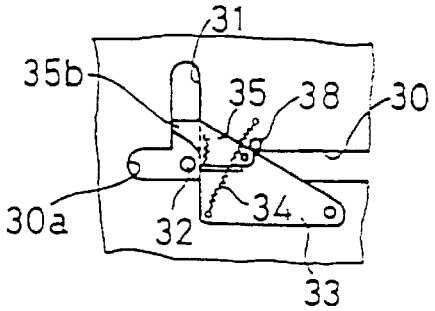
Figure 9D:
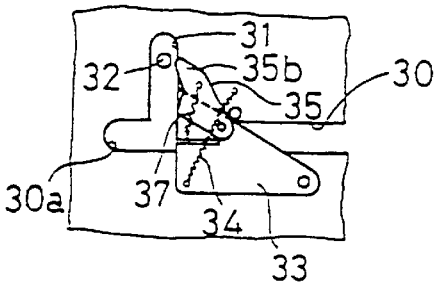
Figure 9E:
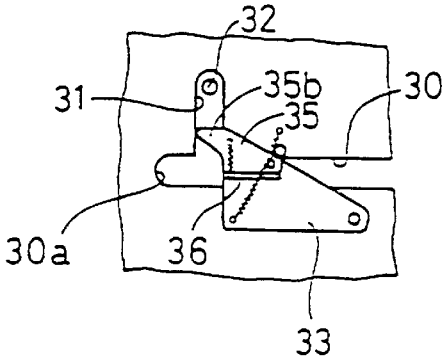

As shown in FIGS. 9C and 9D, during the pressing operation by the stamp solenoid 23, the guiding projection 32 moves along the pressing guide slot 31 so as to push the projection 35*b* of the release lever 35 which partially covers the pressing guide slot 31. As a result, the release lever 35 is moved in the clockwise direction against the compression spring 37. When the guiding projection 32 reaches to the end of the pressing guide slot 31, i.e., the endorsement stamp 10B stamps the check B or the like, the guiding projection 32 leaves the projection 35*b*. Accordingly, the release lever 35 is moved by the compression spring 37 in the counterclockwise direction back to an ordinary position and is stopped by the projection 36.

Figure 9F:
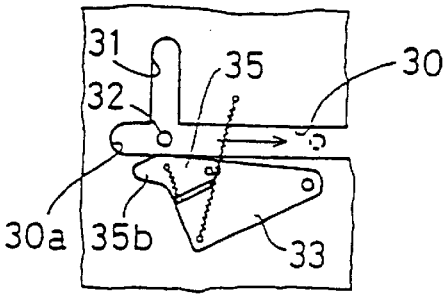

When the stamp operation of the endorsement stamp 10B is finished, the stamp solenoid 23 stops extending so that the holder angle 21B is pulled back into the holder box 18 by the compression spring 25. As shown in FIG. 9F, during the pulling-back operation by the compression spring 25, the guiding projection 32 engages with the projection 35*b* and moves back along the pressing guide slot 31 so as to push the release lever 35 and the lock lever 33 in the counterclockwise direction. When the guiding projection 32 reaches the sliding guide slot 30, the compression spring 19 pulls back the holder box 18 towards the endorsement stamp room 17C side. The pulling-back operation of the compression spring 19 is continued until the normal stamp 10A is placed in the stamping room 17A and the holder box 18 bumps against a stopper projection (not shown). Thus, the holder box 18 returns to the standard position.

Figure 18A:
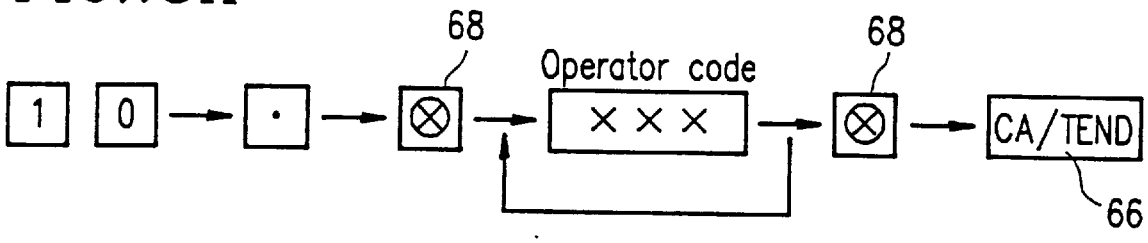
FIG. 18A is a diagram schematically illustrating a set-up operation of code numbers of permitted operators for endorsement transactions.

Next, a set-up operation of operator codes of permitted operators for endorsement transactions will be described. By using the mode switch 41 shown in FIG. 10, the set-up mode is realized in the electronic cash register 100. As shown in FIG. 18A, for example, the set-up mode of the permitted operators for endorsement transactions is realized by inputting "1", "0", and "·" using the numeral key pad 60, and then pressing the multiplication key 68. Thus, the multiplication key is also used for setting up the operator codes (and PINs, as described below).

Operator codes of 3-digits which are provided for respective operators are input by using the numeral key pad 60. Thus input operator codes of the operator codes are usually printed on receipts for sales analysis by clerk. Thus, the operator codes are open to the public so that it is possible for anyone to access the cash register by using someone's operator code. By setting the PIN for a person who is permitted to conduct the endorsement operation, the endorsement operation is well supervised and controlled, since the PIN is not printed on receipts and is in confidence.

The operator code or PIN for an operator who wants to perform endorsement transactions is usually input by the operator at the beginning of registration of the day or at the time when operators take turns. The input operation is performed in a similar manner as that of the operator codes and PIN for permitted-operators described above.

Next, an endorsement transaction is described with reference to FIGS. 19 and 20. First, a normal sales amount is registered (S1). When the sale is paid by check, the paid amount shown on the check is input as a tender by using the numeral key pad 60 (S2), and then the CHK key 64 is pressed to indicate a payment by check (S3).

By pressing the CHK key 64, data which is stored in the permitted-operator memory 52*a* of the endorsement data memory 52 in the RAM 47 is read out, and then a mode decision is performed by the CPU 40 (S4). If there are operator codes of the permitted-operators in the permitted-operator memory 52*a*, a restricted endorsement operator mode is determined to exist. If no operator code of the permitted operator is stored in the output signals $D_0$ and $D_1$ from the buffer 71A and 71B indicate the accommodation states of the stamps 10A and 10B, as explained above with reference to FIG. 14.

Figure 19:
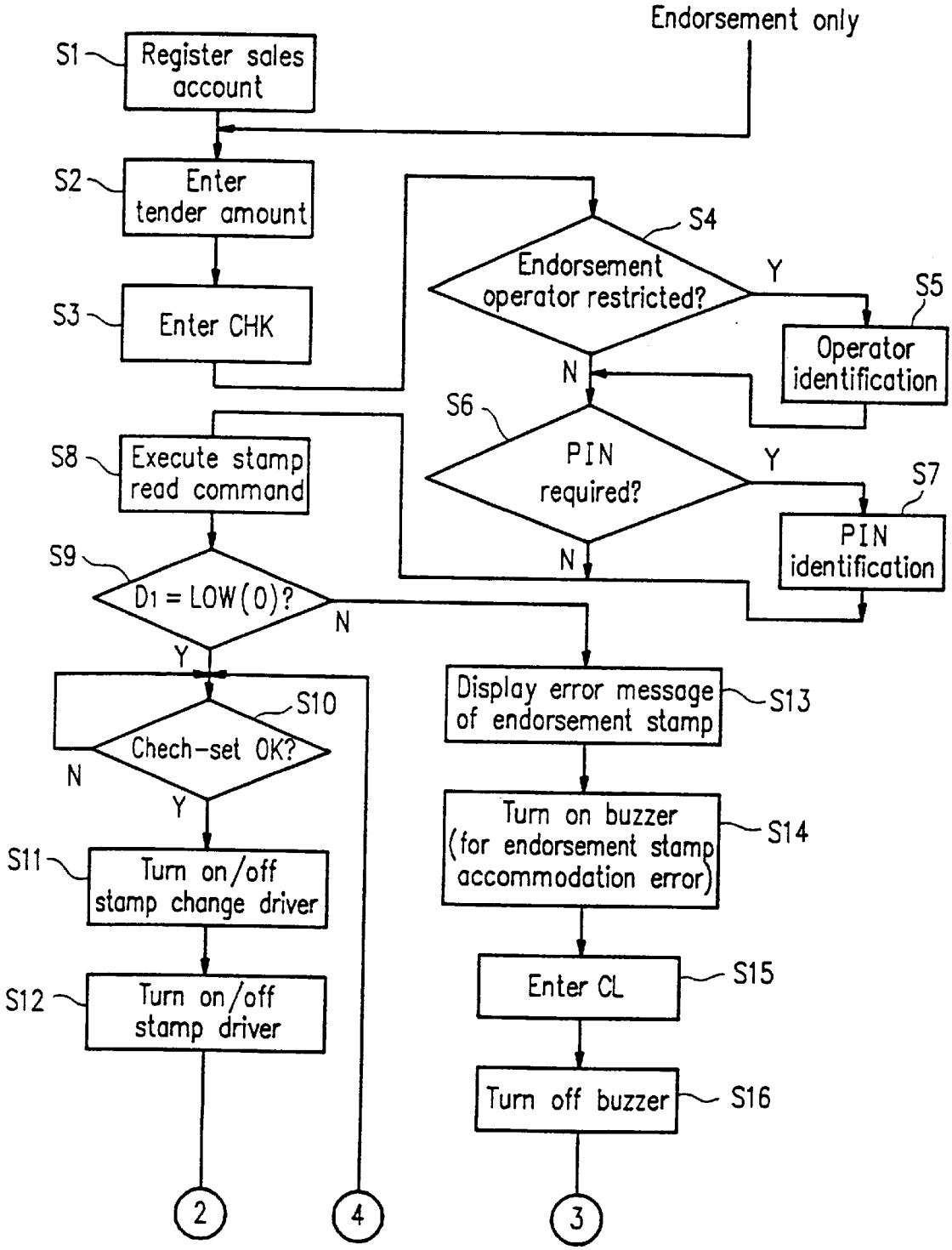
FIGS. 19 and 20 represent a flow chart illustrating steps of an endorsement transaction.

As shown in FIG. 19, it is decided at step S9 whether a signal level of the output signal $D_1$ from the buffer 71B is low (0). When the signal level is low (0), the endorsement stamp 10B is decided to be accommodated correctly; while if the signal level is high, it is decided that the endorsement stamp 10B is erroneously accommodated.

In the case where the endorsement stamp 10B is correctly accommodated, whether a check is correctly set in the stamp mechanism 6 (shown in FIG. 3) is determined in step S10. In step S10, an output of the check sensor 15 is detected to decide whether the check B is inserted correctly between the check guide 14 so as to reach the stopper 13. When the correct setting of the check B is decided, the stamp change driver 42 is turned on and then turned off after a predetermined time (S11).

By turning on and turning off the stamp change driver 42, the stamp change solenoid 20 is driven for the predetermined time period, whereby the endorsement stamp 10B is moved to the stamping room 17A so as to replace the normal stamp 10A. The endorsement stamp 10B held in the holder angle 21B is then placed in the stamping room 17A by using the lock lever 33 as described above with reference to FIGS. 9A to 9F.

Then, as shown in FIG. 19, the stamp driver 43 is turned on and then turned off after a predetermined permitted operators are stored in the permitted-operator memory 52*a* of the RAM 47. When the input operation is finished, the multiplication key 68 is pressed and then the CA/TEND key 66 is pressed, indicating the end of the set-up operation.

Figure 18B:
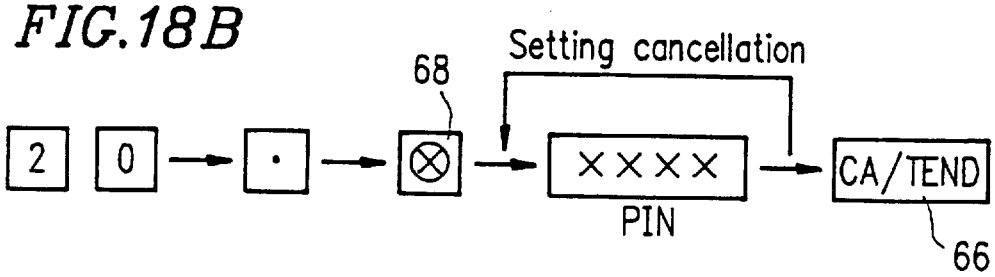
FIG. 18B is a diagram schematically illustrating a set-up operation of PINs of permitted operators for endorsement transactions.

Next, a set-up operation of a PIN will be described. By using the mode switch 41 shown in FIG. 10, the set-up mode is realized in the electronic cash register 100. As shown in FIG. 18B, for example, the set-up mode for PIN is realized by inputting "2", "0", and "·" using the numeral key pad 60, and then pressing the multiplication key 68.

A PIN of 4-digits is input by using the numeral key pad 60, so that the PIN is stored in the PIN memory 52*b* of the RAM 47. A plurality of PINs may be input and stored in the PIN memory 52*b*. When the input operation is finished, the CA/TEND key 66 is pressed in order to indicate the end of the setting-up operation.

In the case where the PIN is not needed for endorsement transactions, the registered PINs are erased from the PIN memory 52*b* by the following operation: inputting "2", "0", and "·" using the numeral key pad 60, and then pressing the CA/TEND key 66 without inputting any PIN, indicating the end of the set-up operation. Thus, an operator is not required to input the PIN to perform endorsement transactions.

Each operator code is assigned to a respective personnel or clerk in order to allow register access and to identify someone who operates the cash register. The permitted-operator memory 52*a*, it is decided that the electric cash register 100 is not in the restricted endorsement operator mode.

In the former case, operator identification for endorsement is performed (S5) and then it is detected whether a PIN is required or not (S6). In the latter case, without performing the operator identification step (S5), the PIN identification step (S6) is performed. The operator identification step (S5) will be described later in more detail with reference to FIG. 21.

In step S6, data stored in the PIN memory 52*b* of the endorsement data memory 52 in the RAM 47 is read out. If at least one PIN is stored in the PIN memory 52*b*, a PIN requirement mode is determined to exist. If no PIN is stored in the PIN number memory 52*b*, it is decided that the electric cash register 100 is not in the PIN requirement mode.

When the PIN requirement mode is determined to exist, identification of the PIN is performed (S7) and then a stamp read command is performed (S8). When no PIN is required, without performing the PIN identification step (S7), the stamp read command is performed (S8). The PIN identification step (S7) will be described later in more detail with reference to FIG. 22.

In step S8, by outputting the stamp read signal SR to the buffers 71A and 71B, the sensor signals 112*a* and 112*b* from the stamp sensors 22A and 22B are read into the CPU 40 as the output signals $D_0$ and $D_1$, as described above with reference to the FIG. 13. The time (S12). By turning on and turning off the stamp driver 43, the stamp solenoid 23 is driven for the predetermined time period, whereby the endorsement stamp 10B is pressed and stamped on the check B. When the stamp operation of the endorsement stamp 10B is finished, the endorsement stamp 10B is pulled back to the stamp holder 18, as described above. At this point, the fixation of the lock lever 33 is released and the endorsement stamp 10B is pulled back to the endorsement stamp room 17C and the normal stamp 10A is placed in the stamping room 17A instead.

In the case where it is decided that the endorsement stamp 10B is not correctly accommodated, an error message indicating the wrong accommodation of the endorsement stamp 10B is displayed on the display 3 (S13). In addition, a beeping sound for warning of the accommodation error is made by the buzzer 44 (S14).

An operator recognizes from the error message and the beeping sound which stamp is wrongly accommodated, and presses the CL key 67 (S15). The buzzer 44 stops beeping when the CL key 67 is pressed (S16). As shown in FIG. 20, after step S16, the operator decides whether the endorsement transaction is to be continued (S17). The operator reaccommodates the endorsement stamp 10B (S18), or presses the CL key 67 again when he or she does not want to continue the endorsement transaction (S23).

The CPU 40 judges whether the endorsement transaction is to be continued by detecting the reaccommodation of the endorsement stamp 10B or entering of the CL key 67 again. In the case where the endorsement transaction is continued, the CPU 40 makes a stamp read command and waits 500 ms (S19) and detects the output signal $D_1$ from the buffer 71B to judge whether the output signal $D_1$ is low (0) (S20). Steps S19 and S20 are the same as steps S8 and S9, and are performed repeatedly until the correct accommodation of the endorsement stamp 10B is detected at step S20.

When the correct accommodation of the endorsement stamp 10B is detected, the error message thereof is cleared from the display 3 (S21). The operator presses the CHK key 64 to indicate continuing the endorsement transaction (S22), and the procedure returns to step S10, as shown in FIG. 19.

In the case where the endorsement transaction is not continued but the CL key 67 is entered (S23), the whole transaction including the registration of the sales amount is canceled (S24). The error message of the wrong accommodation of the endorsement stamp 10B is cleared at the same time as the cancellation of the transaction at step 24.

In a check cashing transaction, step S1 for registering the sales amount is not needed, so that the procedure is started at step S2 for endorsement only as shown in FIG. 19.

Figure 21:
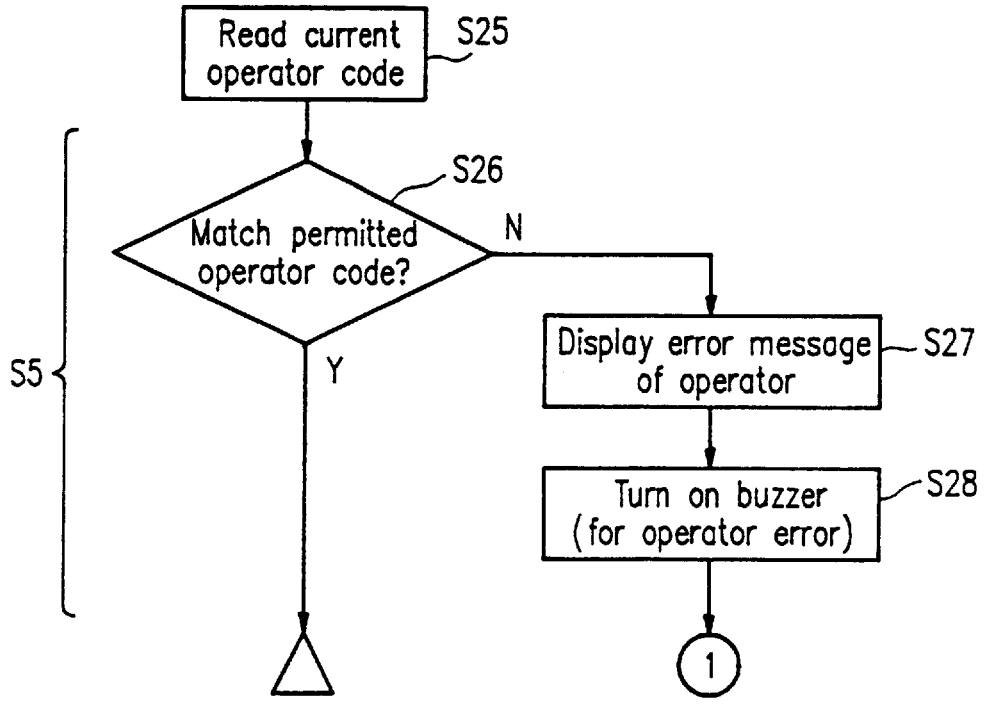
FIG. 21 is a flow chart illustrating identification of a permitted operator for endorsement transactions.

Next, the operator identification for endorsement (S5) is explained in more in detail with reference to FIG. 21. An operator of the electric cash register 100 inputs his or her own operator code to the current operator memory 51 in the RAM 47 (shown in FIG. 11) prior to starting a transaction operation. Thus, when the current operator starts the endorsement transaction and the procedure comes to step S5, the CPU 40 reads the operator code of the operator from the current operator memory 51 in the RAM 47 (S25). The operator code as read is compared with operator codes stored in the permitted-operator memory 52*a* for operators who are allowed to perform endorsement transactions (S26).

When the operator code entered by the current operator matches one of the operator codes of permitted operators, the current operator is identified as a permitted operator so that the procedure goes to step S6. In the case where the operator code of the current operator does not match any of the permitted operator codes, the current operator is decided to be a non-permitted operator for endorsement. As a result, an error message indicating an operator error such as that shown in FIG. 15C is displayed on the display 3 (S27).

Figure 20:
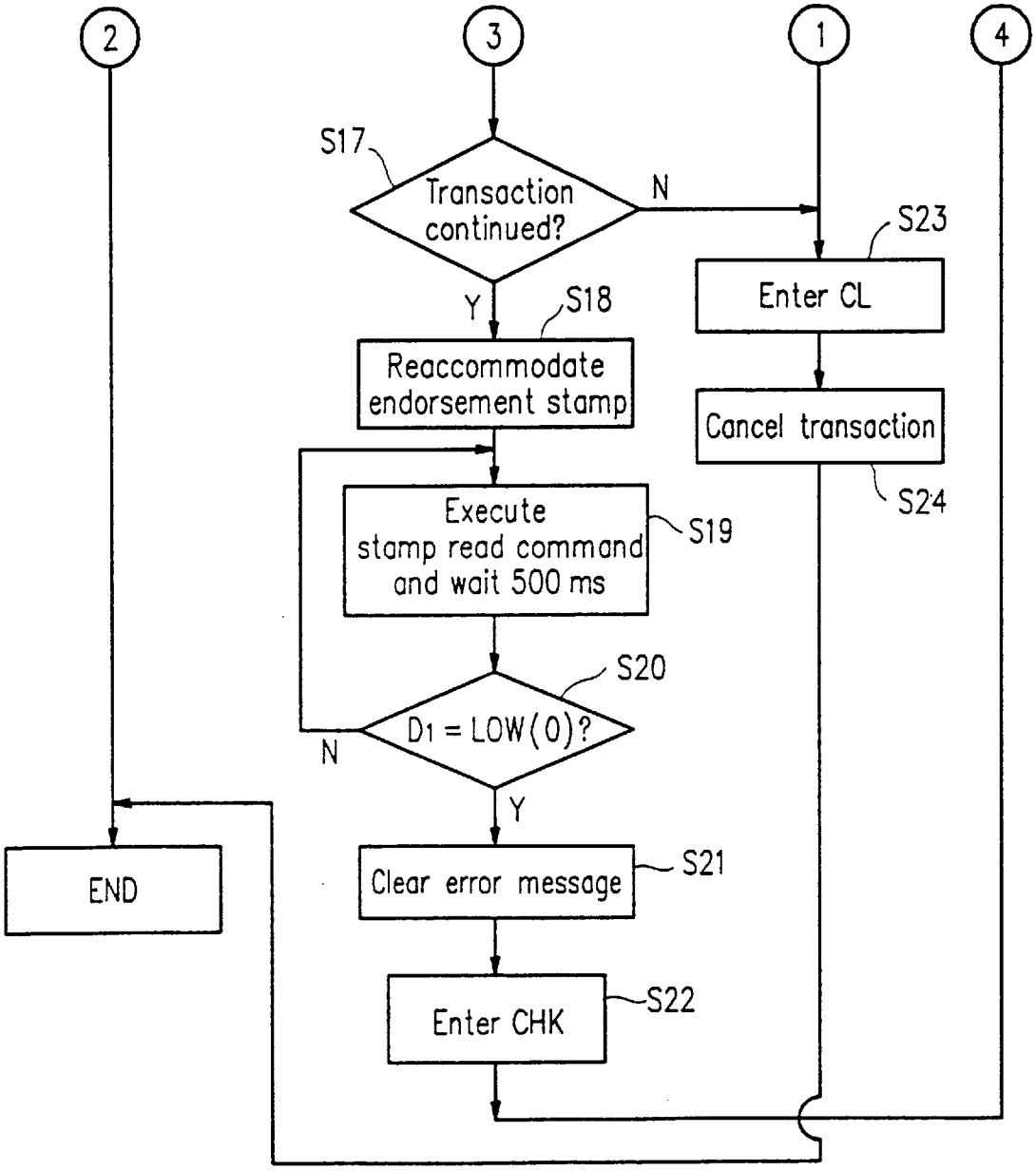

In addition, a beeping sound for warning the operator error is made by the buzzer 44 (S28), and then the procedure goes to step S23 shown in FIG. 20. Thus, the non-permitted operator is prohibited from performing the endorsement transaction.

Figure 22:
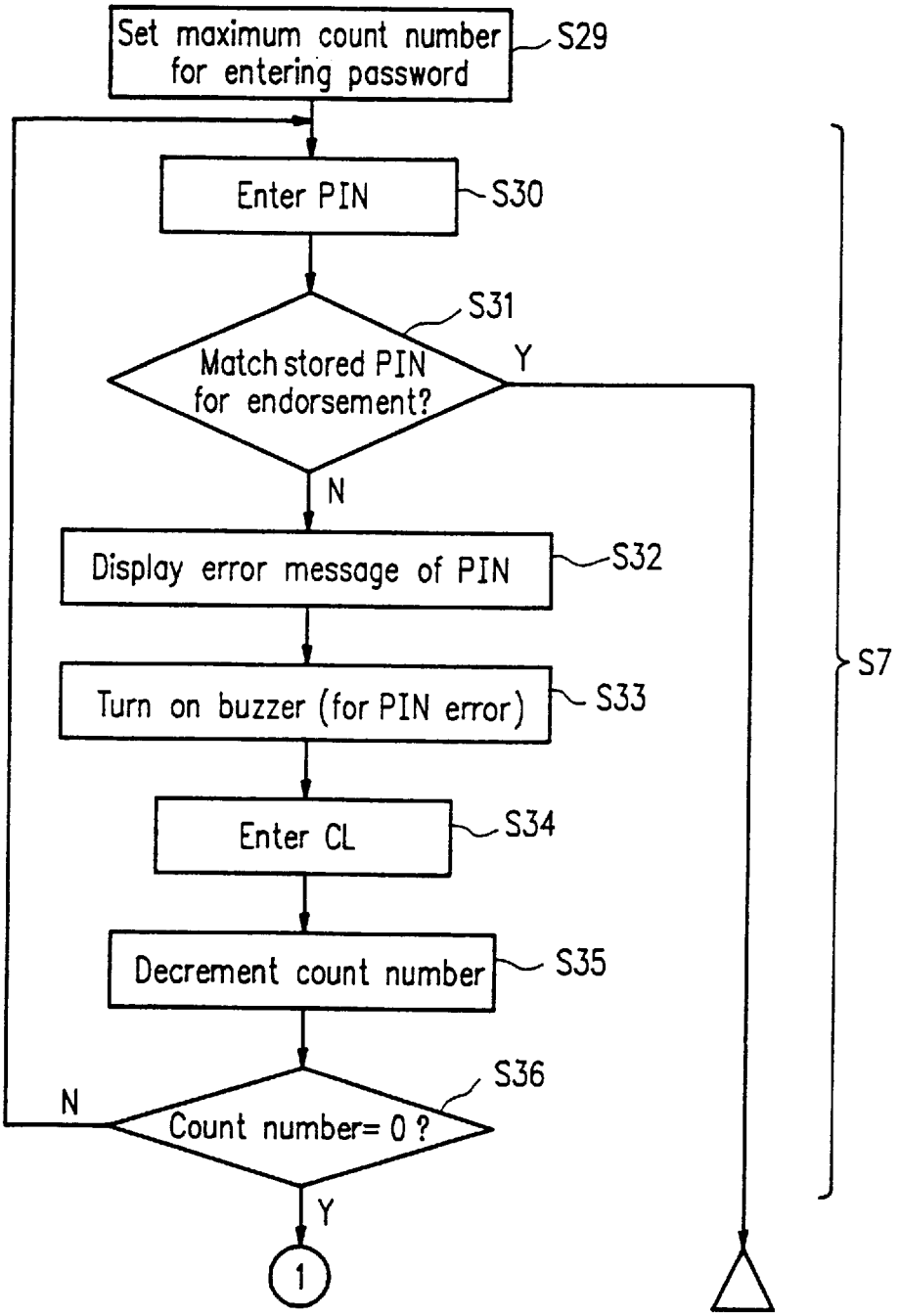
FIG. 22 is a flow chart illustrating identification of a PIN for endorsement transactions entered by an operator.

Next, the PIN identification for endorsement transaction (S7) is explained in more in detail with reference to FIG. 22. Prior to a transaction operation, a maximum permissible count number (for example, "three") for entering the PIN is input to the input counter 52*c* of the RAM 47 (shown in FIG. 11) (S29).

An current operator who wants to perform the endorsement transaction enters his or her PIN (for example, a 4-digit number) by using the numeral key pad 60 (S30). The CPU 40 compares the entered PIN with the PIN(S) stored in the PIN memory 52*b* of the RAM 47 (S31).

Figure 15D:
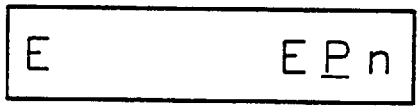

When the entered PIN matches the PIN stored in the PIN memory 52*b*, the current operator is identified as a permitted operator for endorsement so that the procedure goes to step S8. In the case where the entered PIN number does not match any PIN(S) in the PIN memory 52*b*, an error message indicating a PIN error as that shown in FIG. 15D is displayed on the display 3 (S32), and a beeping sound for warning the PIN error is made by the buzzer 44 (S33).

The operator who recognizes the PIN error from the error message (S32) and the beeping sound (S33) presses the CL key 67 to stop the beeping sound (S34). The input counter decrements the permissible count by one when the CL key 67 is pressed (S35). Then the CPU 40 judges whether the decremented permissible count is zero (S36). If the judgement is negative, the procedure returns to step S30 to wait for reentering of the PIN. If the judgment is affirmative, the current operator is decided to be a non-permitted operator for endorsement so that the procedure goes to step S23. Thus, the non-permitted operator who does not know the PIN is prohibited from continuing the endorsement transaction.

Next, a normal transaction operation is described with reference to FIG. 23. First, a normal sales amount is registered (S37) and a tendered cash amount is input by using the numeral key pad 60 (S38). Then, the CA/TEND key 66 is pressed to indicate a payment by cash (S39) and the stamp read command is performed (S40).

In step S40, as is in the case of step S8, the output signals $D_0$ and $D_1$ which indicate the accommodation states of the stamps 10A and 10B are read into the CPU 40 via the buffers 71A and 71B by outputting the stamp read signal SR to the buffers 71A and 71B.

Figure 23:
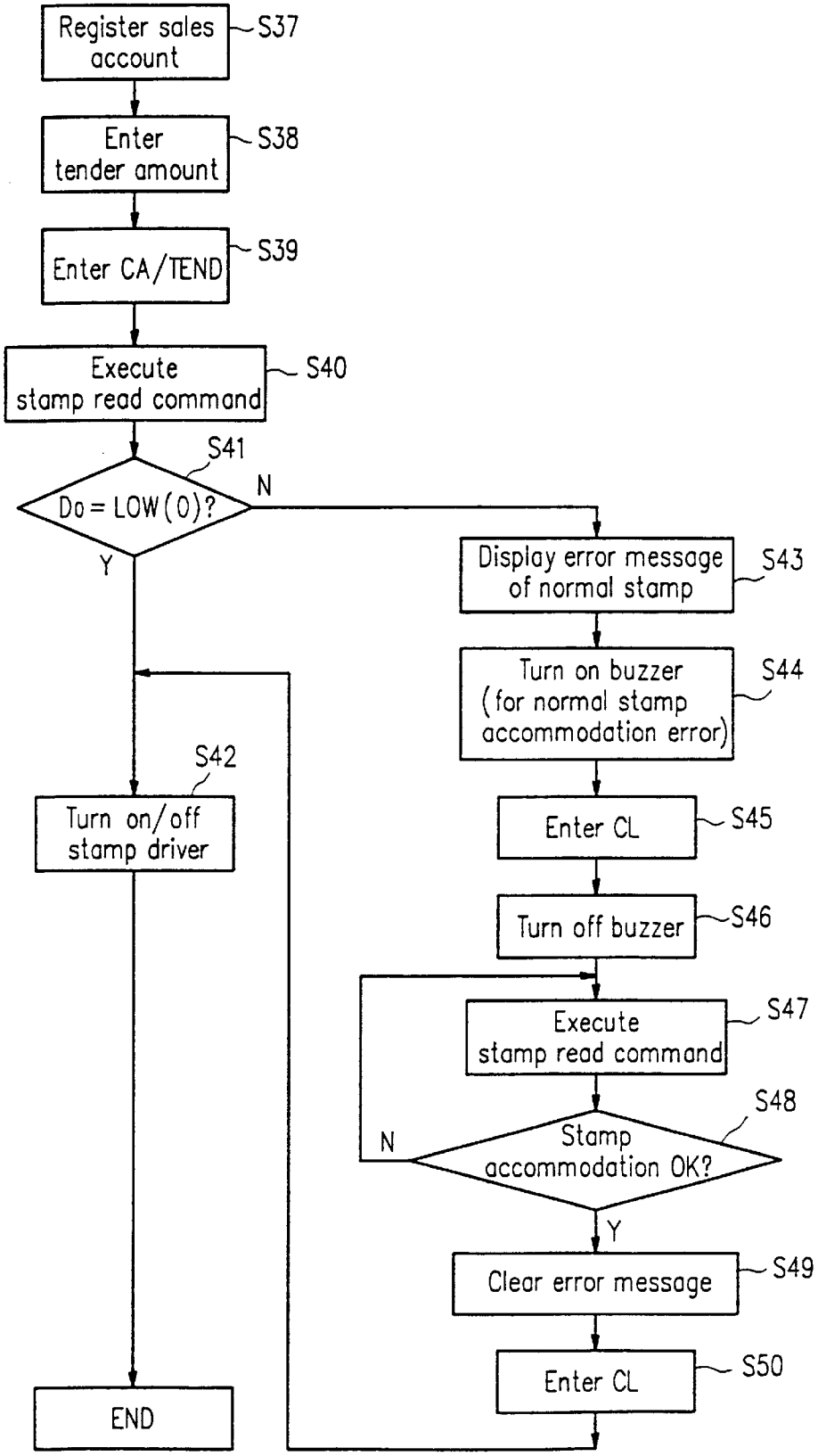
FIG. 23 is a flow chart illustrating steps of a normal registration transaction.

As shown in FIG. 23, at step S41, it is decided whether a signal level of the output signal $D_0$ from the buffer 71A is low (0). When the signal level is low (0), the normal stamp 10A is decided to be accommodated correctly; while if the signal level is high, it is decided that the normal stamp 10A is erroneously accommodated or not accommodated.

In the case where the correct accommodation of the normal stamp 10A is detected in step S41, the stamp driver 43 is turned on and then turned off after a predetermined time (S42). By turning on and turning off the stamp driver 43, the stamp solenoid 23 is driven for the predetermined time period, whereby the normal stamp 10A is stamped on the receipt paper A'.

In the case where it is decided in step S41 that the normal stamp 10A is not correctly accommodated, an error message indicating an accommodation error in the normal stamp 10A (as shown in FIG. 15A) is displayed on the display 3 (S43). In addition, a beeping sound for warning of the accommodation error in the normal stamp 10A is made by the buzzer 44 (S44).

An operator who recognizes the accommodation error in the normal stamp 10A from the error message and the beeping sound presses the CL key 67 (S45). The buzzer 44 stops beeping when the CL key 67 is pressed (S46). The operator reaccommodates the normal stamp 10A, and the CPU 40 performs a stamp read command (S47) and detects whether the normal stamp 10A is correctly accommodated (S48). Steps S47 and S48 are the same as steps S40 and S41, and are repeated until the correct accommodation is detected at step S48.

When the correct accommodation of the normal stamp 10A is detected, the error message is cleared from the display 3 (S49). The operator presses the CL key 67 to indicate continuing the normal transaction (S50), and the procedure returns to step S42.

As described above, according to the present invention, stamp operations using different stamps are performed efficiently by the same stamp mechanism. The stamps are automatically changed and operators are not required to exchange the stamps prior to a stamp operation. In addition, the stamp selection and stamp change mechanism is realized by relatively simple structure, resulting in a reduction of the cost of the electric cash register.

By providing a warning system for accommodation error in the stamps (error message and beeping sound), the operators can ensure the correct accommodation of the stamps prior to the stamp operation. Furthermore, by providing a warning system to ensure that a check is properly inserted, stamp operations are performed without fail.

By providing an identifying system (operator code and/or PIN) for permitted operators for endorsement transactions, the endorsement transactions are supervised and controlled efficiently.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A stamp pressing device comprising:

a housing movably supporting and housing at least two stamps;

a selection mechanism cooperatively engaged with the at least two stamps, the selection mechanism positioning the at least two stamps in the housing in accordance with a selected one of the at least two stamps; and a pressing mechanism disposed adjacent the housing, the pressing mechanism pressing the selected stamp on a sheet, wherein the housing includes a stamping room disposed opposite to the sheet, a first room provided for a first stamp on one side of the stamping room, and a second room provided for a second stamp on the other, the selection mechanism includes means for replacing one stamp in the stamping room with the other by moving the first and second stamps along an elongate direction in which the stamping room and the first and second rooms are disposed, the pressing mechanism presses the stamp which is placed in the stamping room against the sheet, the housing includes holder means for holding the first and second stamps coupled in a series, and the replacing means includes first means for forcing the coupled stamps towards one side of the housing along the elongate direction and second means for moving the coupled stamps towards the other against the force of the first means, whereby one of the coupled stamps is placed in the stamping room.

2. A stamp pressing device comprising:

a housing movably supporting and housing at least two stamps;

a selection mechanism cooperatively engaged with the at least two stamps, the selection mechanism positioning the at least two stamps in the housing in accordance with a selected one of the at least two stamps; and a pressing mechanism disposed adjacent the housing, the pressing mechanism pressing the selected stamp on a sheet;

accommodation detecting means for detecting whether the at least two stamps are accommodated correctly in the housing; and warning means for indicating an accommodation error based on the detection of the accommodation detecting means, wherein the warning means makes a different kind of warning for each stamp.

3. A data processing apparatus comprising:

a housing movably supporting and housing at least two stamps;

a selection mechanism cooperatively engaged with the at least two stamps, the selection mechanism positioning the at least two stamps in the housing in accordance with a selected one of the at least two stamps; and a pressing mechanism disposed adjacent the housing, the pressing mechanism pressing the selected stamp on a sheet, wherein the housing includes a stamping room disposed opposite to the sheet, a first room provided for a first stamp on one side of the stamping room, and a second room provided for a second stamp on the other, the selection mechanism includes means for replacing one stamp in the stamping room with the other by moving the first and second stamps along a direction in which the stamping room and the first and second rooms are disposed, the pressing mechanism presses the stamp which is placed in the stamping room against the sheet, wherein the first and second stamps are coupled in a series, and the replacing means includes first means for forcing the coupled stamps towards the first room side and second means for moving the coupled stamps towards the second room side against the force of the first means, whereby one of the coupled stamps is placed in the stamping room.

4. A data processing apparatus comprising:

a housing movably supporting and housing at least two stamps a selection mechanism cooperatively engaged with the at least two stamps, the selection mechanism positioning the at least two stamps in the housing in accordance with a selected one of the at least two stamps;

a pressing mechanism disposed adjacent the housing, the pressing mechanism pressing the selected stamp on a sheet;

accommodation detecting means for detecting whether the stamps are accommodated correctly in the housing; and warning means for indicating an accommodation error based on the detection of the accommodation detecting means, wherein the warning means makes a different kind of warning for each stamp.

5. A method for stamping using at least two stamps and a stamp pressing device comprising a housing for movably supporting and housing the at least two stamps, the housing having a stamping room, a first room for a first stamp on one side of the stamping room, and a second room for a second stamp on the other, the method including the steps of:

(a) selecting one of the at least two stamps accommodated in the housing;

(b) placing the selected stamp in the stamping room; and (c) pressing the selected stamp against a sheet, wherein step (b) includes step (b1) of replacing one stamp in the stamping room with the other by moving the first and second stamps along a direction in which the stamping room and the first and second rooms are disposed, and wherein the first and second stamps are coupled in a series, and step (b1)includes the steps of:

(b2) forcing the coupled stamps towards the first room side; and (b3) moving the coupled stamps towards the second room side against the force applied in step (b2), whereby one of the coupled stamps is placed in the stamping room.

6. A method for stamping using at least two stamps and a stamp pressing device comprising a housing for movably supporting and housing the at least two stamps, the housing having a stamping room, a first room for a first stamp on one side of the stamping room, and a second room for a second stamp on the other, the method including the steps of:

(a) selecting one of the at least two stamps accommodated in the housing;

(b) placing the selected stamp in the stamping room;

(c) pressing the selected stamp against a sheet;

(d) detecting whether the stamps are accommodated correctly in the housing; and (e) indicating and warning an accommodation error based on a detection result of step (d), wherein in step (e), a different kind of warning is made for each stamp.

7. A stamp pressing device comprising:

a stamp housing for housing at least two stamps, including a frame box having an elongate box shape, including a stamping room, a first room disposed on one side of the stamping room along the elongate direction, and a second room disposed on the other, and a holder box slidably provided in the frame box along the elongate direction, for holding the at least two stamps arranged in a row along the elongate direction, wherein the frame box has a guide slot for guiding the holder box to slide along the elongate direction in the frame box;

a selection mechanism including an elastic member provided between the frame box and the holder box so as to bias the holder box towards the second room side to a first position in the frame box, a first stamp being placed in the stamping room at the first position, and a first moving member coupled to the holder box and said first moving member sliding the holder box towards the first room side against the elastic force of the elastic member to a second position in the frame box, a second stamp being placed in the stamping room at the second position; and a pressing mechanism provided so as to face the stamping room and including a second moving member for moving in a direction perpendicular to the elongate direction of the frame box and for pressing a stamp placed in the stamping room against a sheet.

8. A stamp pressing device according to claim 7, wherein the frame box has a second guide slot for guiding the stamp in the stamping room to slide towards the sheet and to return to a previous position in the stamping room.

9. A stamp pressing device according to claim 8, wherein the frame box has a lock mechanism for holding the holder box at the second position against the elastic force of the elastic member.

10. A stamp pressing device according to claim 9, wherein the frame box has a release mechanism for releasing the lock mechanism when the stamp returns to the stamping room after stamping on the sheet, whereby the holder box is moved from the second position to the first position by the elastic force of the elastic member.

* * * * *